US005865185A

United States Patent [19]

Collins et al.

[11] Patent Number: 5,865,185

[45] **Date of Patent: *Feb. 2, 1999**

[54] FLAVOR GENERATING ARTICLE

[75] Inventors: Alfred L. Collins, Powhatan; Mary Ellen Counts, Richmond; Amitabh Das, Midlothian; Seetharama C. Deevi, Midlothian; Grier S. Fleischhauer, Midlothian; Charles T. Higgins; Willie G. Houck, Jr., both of Richmond; Billy J. Keen, Jr., Chesterfield; Robert E. Lee, III, Richmond; A. Clifton Lilly, Jr., Chesterfield; D. Bruce Losee, Jr., Richmond; Hugh J. McCafferty; Constance H. Nichols, both of Midlothian; Wynn R. Raymond, Chesterfield; Robert L. Ripley; Renzer R. Ritt, Sr., both of Richmond; G. Robert Scott, Midlothian; F. Murphy Sprinkel, Glen Allen; Michael L. Watkins, Chester; Susan E. Wrenn, Chesterfield; Francis V. Utsch, Midlothian, all of Va.

[73] Assignee: Philip Morris Incorporated, New York, N.Y.

[ * ] Notice: The portion of the term of this patent subsequent to Sep. 10, 2013, has been disclaimed.

[21] Appl. No.: 448,906

[22] Filed: May 24, 1995

Related U.S. Application Data

[60] Division of Ser. No. 943,504, Sep. 11, 1992, Pat. No. 5,505,214, which is a continuation-in-part of Ser. No. 666, 926, Mar. 11, 1991, abandoned.

[51] Int. Cl.[6] ..... A24F 1/00

[52] U.S. Cl. ..... 131/194; 131/271; 131/329; 128/200.14; 128/202.21; 128/203.27

[58] Field of Search ..... 131/194, 329, 131/271; 128/202.21, 203.27, 200.14

[56] References Cited

U.S. PATENT DOCUMENTS

| | | | |
|---|---|---|---|
| 1,771,336 | 7/1930 | Wyss et al. . | |
| 1,968,509 | 7/1934 | Tiffany | 219/38 |
| 2,057,353 | 10/1936 | Whittemore, Jr. | 219/38 |
| 2,104,266 | 1/1938 | McCormick | 131/12 |
| 2,442,004 | 5/1948 | Hayward-Butt | 128/200 |
| 2,974,669 | 3/1961 | Ellis | 131/172 |

(List continued on next page.)

FOREIGN PATENT DOCUMENTS

| | | | |
|---|---|---|---|
| 1202378 | 3/1986 | Canada | B23K 3/02 |
| 87/104459 | 2/1988 | China . | |
| 0 295 122 | 12/1988 | European Pat. Off. | A24F 47/00 |
| 0 358 002 | 3/1990 | European Pat. Off. | A24F 47/00 |
| 0 358 114 | 3/1990 | European Pat. Off. | A61M 15/00 |
| 0 430 566 A2 | 6/1991 | European Pat. Off. | A24F 47/00 |
| 0 438 862 A2 | 7/1991 | European Pat. Off. | A24F 47/00 |
| 3 640 917 | 8/1988 | Germany | A45D 34/02 |
| 3 735 704 | 5/1989 | Germany | A61L 9/03 |
| 61-68061 | 4/1986 | Japan | A61M 15/06 |
| 2 132 539 | 7/1984 | United Kingdom | B23K 3/02 |
| 2 148 079 | 5/1985 | United Kingdom | B23K 3/02 |
| 2 148 676 | 5/1985 | United Kingdom | H05B 3/28 |
| WO 86/02528 | 5/1986 | WIPO | A24B 15/18 |
| WO 95/05094 | 2/1995 | WIPO | A24F 47/00 |

*Primary Examiner*—V. Millin
*Assistant Examiner*—William J. Deane, Jr.
*Attorney, Agent, or Firm*—Charles E. B. Glenn; James E. Schardt; James T. Moore

[57] ABSTRACT

A smoking article is provided in which a replaceable tobacco flavor unit containing tobacco flavor material is electrically heated by a set of permanent reusable heaters to evolve flavors or other components in vapor or aerosol form for delivery to a smoker. Each heater heats only a portion of the available tobacco flavor material so that a plurality of individual puffs of tobacco flavor substance can be delivered sequentially to the smoker. The replaceable tobacco flavor unit can also include a filter to reduce the effect of residual aerosol which settles or condenses on the permanent portions of the article and which can result in undesirable flavor generation when reheated. A method and apparatus for manufacturing the replaceable tobacco flavor unit is also provided.

75 Claims, 12 Drawing Sheets

U.S. PATENT DOCUMENTS

| | | | |
|---|---|---|---|
| 3,200,819 | 8/1965 | Gilbert | 128/208 |
| 3,255,760 | 6/1966 | Selke | 131/8 |
| 3,363,633 | 1/1968 | Weber | 131/178 |
| 3,402,723 | 9/1968 | Hu | 131/185 |
| 3,482,580 | 12/1969 | Hollebaugh | 131/178 |
| 3,496,336 | 2/1970 | Hingorany et al. | 219/464 |
| 3,591,753 | 7/1971 | Gartner | 219/464 |
| 3,608,560 | 9/1971 | Briskin | 131/2 |
| 3,738,374 | 6/1973 | Bennett | 131/2 |
| 3,744,496 | 7/1973 | McCarty et al. | 131/8 |
| 3,804,100 | 4/1974 | Fariello | 131/173 |
| 3,889,690 | 6/1975 | Guarnieri | 131/185 |
| 4,016,061 | 4/1977 | Wasa et al. | 204/192 |
| 4,068,672 | 1/1978 | Guerra | 131/170 |
| 4,077,784 | 3/1978 | Vayrynen | 55/146 |
| 4,131,119 | 12/1978 | Blasutti | 131/187 |
| 4,141,369 | 2/1979 | Buurruss | 131/171 |
| 4,164,230 | 8/1979 | Pearlman | 131/171 |
| 4,193,411 | 3/1980 | Faris et al. | 131/171 |
| 4,194,108 | 3/1980 | Nakajima et al. | 219/216 |
| 4,203,025 | 5/1980 | Nakatani et al. | 219/216 |
| 4,215,708 | 8/1980 | Bron | 131/262 |
| 4,219,032 | 8/1980 | Tabatznik et al. | 131/170 |
| 4,246,913 | 1/1981 | Ogden et al. | 131/771 |
| 4,256,945 | 3/1981 | Carter et al. | 219/10.75 |
| 4,259,564 | 3/1981 | Ohkubo | 219/216 |
| 4,259,970 | 4/1981 | Green, Jr. | 131/330 |
| 4,303,083 | 12/1981 | Burruss, Jr. | 131/271 |
| 4,319,591 | 3/1982 | Keith et al. | 131/359 |
| 4,393,884 | 7/1983 | Jacobs | 131/273 |
| 4,431,903 | 2/1984 | Riccio | 219/238 |
| 4,436,100 | 3/1984 | Green, Jr. | 131/330 |
| 4,463,247 | 7/1984 | Lawrence et al. | 219/236 |
| 4,505,282 | 3/1985 | Cogbill et al. | 131/334 |
| 4,562,337 | 12/1985 | Lawrence | 219/421 |
| 4,570,646 | 2/1986 | Herron | 131/185 |
| 4,580,583 | 4/1986 | Green, Jr. | 131/330 |
| 4,621,649 | 11/1986 | Osterrath | 131/185 |
| 4,623,401 | 11/1986 | Derbyshire et al. | 148/13 |
| 4,629,604 | 12/1986 | Spector | 422/124 |
| 4,637,407 | 1/1987 | Bonnano et al. | 131/175 |
| 4,659,912 | 4/1987 | Derbyshire | 219/535 |
| 4,682,010 | 7/1987 | Drapeau et al. | 219/381 |
| 4,686,353 | 8/1987 | Spector | 219/275 |
| 4,692,590 | 9/1987 | Spector | 219/275 |
| 4,694,824 | 9/1987 | Ruderian | 128/203 |
| 4,735,217 | 4/1988 | Gerth et al. | 131/273 |
| 4,771,796 | 9/1988 | Myer et al. | 131/273 |
| 4,776,353 | 10/1988 | Lilja et al. | 131/297 |
| 4,837,421 | 6/1989 | Luthy | 219/272 |
| 4,846,199 | 7/1989 | Rose | 131/329 |
| 4,848,376 | 7/1989 | Lilja et al. | 131/352 |
| 4,874,924 | 10/1989 | Yamamoto et al. | 219/274 |
| 4,877,989 | 10/1989 | Drews et al. | 310/323 |
| 4,922,901 | 5/1990 | Brooks et al. | 128/203.26 |
| 4,945,931 | 8/1990 | Gori | 131/335 |
| 4,947,874 | 8/1990 | Brooks et al. | 131/329 |
| 4,947,875 | 8/1990 | Brooks et al. | 131/330 |
| 4,966,171 | 10/1990 | Seranno et al. | 131/194 |
| 4,981,522 | 1/1991 | Nichols et al. | 131/274 |
| 4,991,606 | 2/1991 | Serrano et al. | 131/359 |
| 4,998,541 | 3/1991 | Perfetti et al. | 131/336 |
| 5,016,656 | 5/1991 | McMurtrie | 131/364 |
| 5,040,552 | 8/1991 | Schleich et al. | 131/359 |
| 5,042,510 | 8/1991 | Curtiss et al. | 131/273 |
| 5,060,671 | 10/1991 | Counts et al. | 131/329 |
| 5,076,296 | 12/1991 | Nystrom et al. | 131/359 |
| 5,093,894 | 3/1992 | Deevi | 392/390 |
| 5,095,921 | 3/1992 | Losee et al. | 131/194 |
| 5,144,962 | 9/1992 | Counts et al. | 131/194 |
| 5,159,940 | 11/1992 | Hayward et al. | 131/194 |
| 5,179,966 | 1/1993 | Losee et al. | 131/351 |
| 5,188,130 | 2/1993 | Hajaligol et al. | 131/359 |
| 5,224,498 | 7/1993 | Deevi et al. | 131/194 |
| 5,235,157 | 8/1993 | Blackburn | 219/268 |
| 5,249,586 | 10/1993 | Morgan et al. | 131/194 |
| 5,269,327 | 12/1993 | Counts et al. | 131/194 |
| 5,274,214 | 12/1993 | Blackburn | 219/268 |
| 5,285,050 | 2/1994 | Blackburn | 219/268 |
| 5,388,594 | 2/1995 | Counts et al.. | 131/194 X |
| 5,479,948 | 1/1996 | Counts et al. | 131/194 |

13
11
20
26
26
25
12
10
3A
3A
21

13
11
22
24
26
20
25
26
4
43
24A
12
10
3
3
30
23
5
5
21
4

FLAVOR GENERATING ARTICLE

CROSS REFERENCE TO RELATED APPLICATIONS

This application is a divisional application of Ser. No. 07/943,504 filed Sep. 11, 1992, now U.S. Pat. No. 5,505,214, which is a continuation-in-part of commonly-assigned U.S. patent application Ser. No. 07/666,926, filed Mar. 11, 1991, now abandoned in favor of filewrapper continuation application Ser. No. 08/012,799, filed Feb. 2, 1993, now U.S. Pat. No. 5,249,586 issued Oct. 15, 1993 which is hereby incorporated by reference in its entirety, which is a continuation of application Ser. No. 07/666,926 filed Mar. 11, 1991, now abandoned.

BACKGROUND OF THE INVENTION

This invention relates to smoking articles in which tobacco flavor media are heated to release tobacco flavors. More particularly, this invention relates to electrically heated smoking articles.

An electrically-heated smoking article is described in commonly-assigned U.S. Pat. No. 5,060,671, which is hereby incorporated by reference in its entirety. That patent describes an electrically-heated smoking article which is provided with a disposable set of electrical heating elements on each of which is deposited an individual charge of tobacco flavor medium containing, for example, tobacco or tobacco-derived material. The disposable heater/flavor unit is mated to a more or less permanent unit containing a source of electrical energy such as a battery or capacitor, as well as control circuitry to actuate the heating elements in response to a puff by a smoker on the article or the depression of a manual switch. The circuitry is designed so that at least one but less than all of the heating elements are actuated for any one puff, so that a predetermined number of puffs, each containing a pre-measured amount of tobacco flavor substance, is delivered to the smoker. The circuitry also preferably prevents the actuation of any particular heater more than once, to prevent overheating of the tobacco flavor medium thereon and consequent production of undesired compounds yielding off tastes.

In such an article, the heating elements are disposed of along with the spent flavor generating medium. This results in increased costs to the smoker, who must buy new heating elements with each refill of tobacco flavor medium. The volume of material disposed of is also greater when the heating elements must be disposed of.

In addition, when the heating elements are disposable, they must by their nature be removable. As a result, there is sometimes excessive contact resistance at the connection where the removable heaters are electrically connected to the source of electrical energy, resulting in increased power consumption. Furthermore, that connection must be designed to withstand repeated insertion of new heating elements after each use.

Also, when the heating elements are disposable, the heater electrical resistance may vary from heater to heater, resulting in variations in power consumption which, in turn, can lead to variations in temperature. As it is the temperature to which the tobacco flavor medium is heated that determines the characteristics of the flavor tobacco substance, those characteristics will also vary.

The above-discussed disadvantages associated with U.S. Pat. No. 5,060,671 are addressed by above-incorporated copending, commonly-assigned U.S. patent application Ser. No. 08/012,799, filed Feb. 2, 1993. That application describes an electrically-heated smoking article that has reusable heating elements and a disposable portion for tobacco flavor generation. The disposable portion preferably includes a tobacco flavor segment and a filter segment, attached by a plug wrap or other fastening means.

A disadvantage of reusable heating elements is that residual aerosol can settle and condense on the heating elements and other permanent structural components of the article, resulting in the generation of undesirable aerosol components if the residual aerosol is reheated after new disposable tobacco flavor medium is inserted into the article. Such residue is referred to as "fixture contamination."

In light of the above, it would therefore be desirable to be able to provide an electrically-heated smoking article in which the heating elements are reusable, and of which the volume of disposable portions is thus minimized.

It would also be desirable to be able to provide such an article in which generation of undesirable aerosol components resulting from the reheating of aerosol that settles or condenses onto the heating elements and other permanent structural components of the article is minimized.

It would further be desirable to be able to provide manufacturing processes for such an article that can be implemented using conventional high-volume assembly machinery.

SUMMARY OF THE INVENTION

It is an object of this invention to provide an electrically heated smoking article in which the heating elements are reusable, and of which the volume of disposable portions is thus minimized.

It is also an object of this invention to provide such an article in which generation of undesirable aerosol components as a result of reheating of aerosol that settles or condenses onto the heating elements and other permanent structural components of the article is minimized.

It is a further object of this invention to provide manufacturing processes for such an article that can be implemented using conventional high-volume assembly machinery.

In accordance with this invention, there is provided a removable tobacco flavor unit for use in a smoking article for delivering to a smoker a tobacco flavor substance, the article having a plurality of permanent electrical heating means disposed in a permanent cavity. The removable tobacco flavor unit includes a carrier having a first end and a second end and having a first surface and a second surface, the first surface defining a flavorant cavity for generating the tobacco flavor substance between said first end and said second end, and the second surface adapted to be disposed adjacent the plurality of electrical heating means. Tobacco flavor generating medium is disposed on the first surface of said carrier. When any one of the plurality of electrical heating means is activated, a respective fraction of said tobacco flavor medium in thermal transfer relationship with said one of said heating means is heated, generating a predetermined quantity of tobacco flavor substance for delivery to the smoker. Filtering means for filtering the predetermined quantity of tobacco flavor substance prior to smoking by the smoker is also provided by the tobacco flavor unit.

A method and apparatus for manufacturing the removable tobacco flavor unit are also provided.

In accordance with the present invention there is also provided a permanent heater fixture for use in a smoking article for delivering to a smoker a tobacco flavor substance, the article having a removable tobacco flavor unit that has tobacco flavor medium disposed on a first surface of a carrier, the carrier having a second surface opposed to the first surface. The permanent heater fixture includes a heater base defining a first end of a cavity for receiving the removable tobacco flavor unit, the cavity having an air passageway from the first end to a second end for allowing air to pass therebetween. The fixture also includes a plurality of permanent electrical heaters disposed on the heater base, the heaters each having a surface adapted to be disposed adjacent the second surface of the carrier. When any one of said plurality of electrical heating means is activated, a respective fraction of said tobacco flavor medium in thermal transfer relationship with said one of said heating means is heated, generating a predetermined quantity of tobacco flavor substance for delivery to the smoker.

The present invention further includes a smoking article for delivering to a smoker a tobacco flavor substance. The article can include both the permanent heater fixture and the removable tobacco flavor unit of the present invention.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE INVENTION

Figures 1, 2:
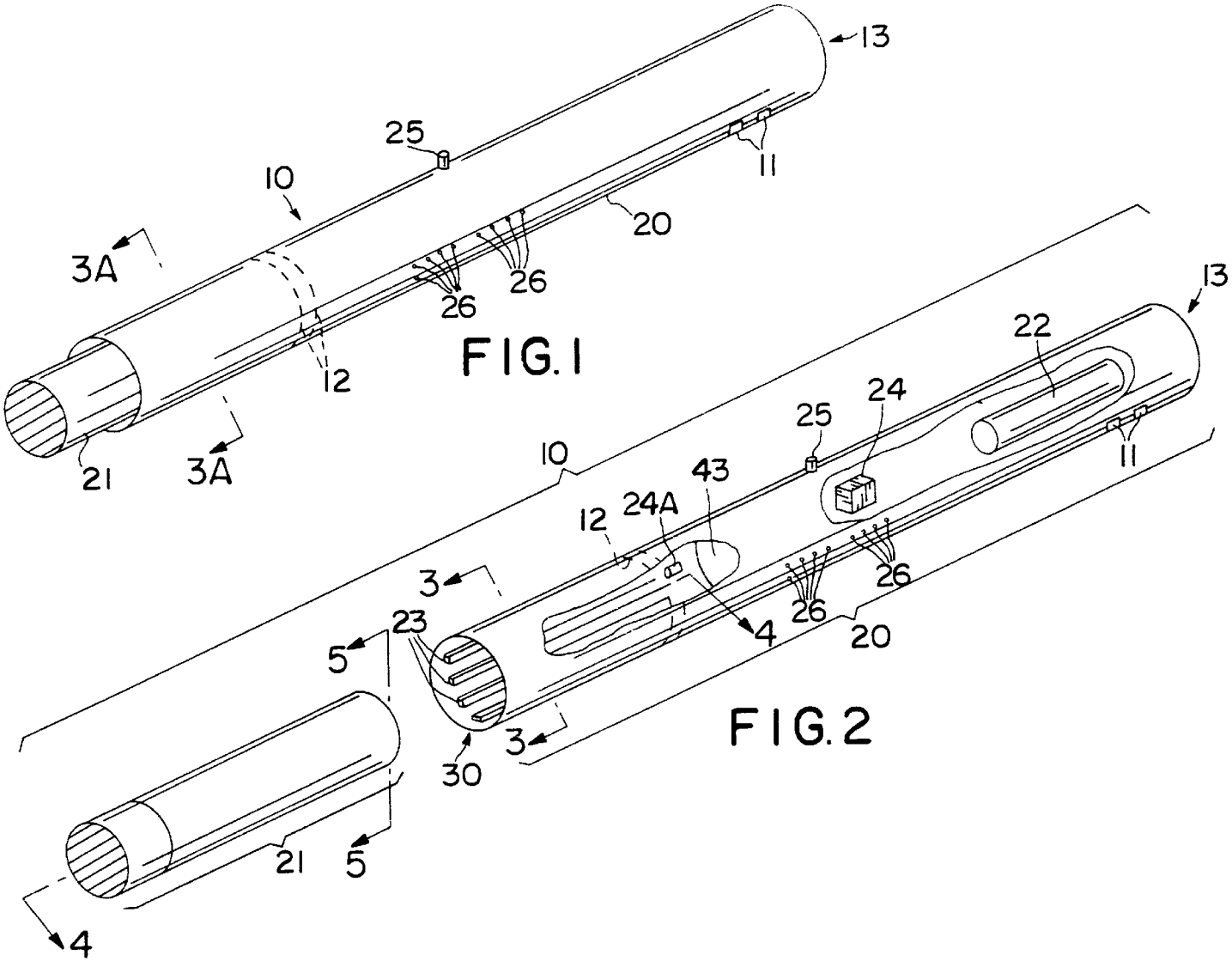
FIG. 1 is a perspective view of an electrical smoking article according to this invention.
FIG. 2 is a partially fragmentary, exploded perspective view of the electrical smoking article of FIG. 1.

An electrical smoking article according to the present invention can be used, for example, to simulate a cigarette. In such a case, the tobacco flavor medium would be a material containing tobacco or tobacco derivatives. In accordance with the invention, the electrical smoking article would include a removable disposable unit which includes the tobacco flavor medium and residual aerosol filters or barriers to prevent undesirable deposition of aerosol condensate. The disposable tobacco flavor unit can also include, if desired, a free-flow filter for filtering main-stream aerosol prior to delivery to the smoker.

The disposable tobacco flavor unit of the electrical smoking article of the present invention is inserted into a reusable "permanent" portion including a source of electrical energy, a set of reusable heating elements, and control circuitry for energizing the heaters in an appropriate sequence, in response to manual actuation or puff-induced actuation. Preferably, the present invention also includes control circuitry for delivering a predetermined amount of electrical energy to each heater upon actuation, independent of the power supply loaded voltage. Other suitable control circuitry is also described in above-incorporated commonly-assigned U.S. Pat. No. 5,060,671, which is hereby incorporated by reference.

The reusable or permanent portion includes a permanent cavity at the mouth end thereof for insertion of the disposable tobacco flavor unit. The reusable heaters are disposed in the permanent cavity in such a way that they are in thermal transfer relationship with the disposable tobacco flavor unit when the unit is inserted into the permanent cavity. This can be accomplished by having the heaters protrude from the sides of the cavity and making the disposable unit partly compressible, so that the heaters press into the carrier material which supports the tobacco flavor medium, to be discussed below, on the tobacco flavor unit.

When reusable heaters are used, it is important that condensation of aerosol onto power source components, control circuitry, and other permanent structural portions, and particularly the heating elements, of the article be minimized. Otherwise, residues from a previous use (i.e., fixture contamination), which might include partially oxidized, pyrolized or thermally decomposed constituents of the tobacco flavor medium, might be reheated, possibly giving rise to undesirable compounds and off tastes being delivered to the smoker. Such residues are not of concern when the heaters are disposable, as in above-discussed U.S. Pat. No. 5,060,671, because normally they are never reheated, but may be of concern where reusable heaters are provided, as in the present invention.

The permanent heaters of the present invention are isolated from the tobacco flavor air passageway and aerosol cavity. This isolation minimizes condensation of aerosol onto the heaters and therefore minimizes aerosol residue reheating and undesirable flavor generation. Additionally, a back-flow filter is preferably also provided to reduce or substantially prevent the back flow of aerosol from the tobacco flavor cavity towards the power source components and control circuit. Such back flow of aerosol may give rise to the generation of undesirable flavors if the aerosol is able to condense onto surfaces that may be elevated in temperature.

Although the permanent heaters of the present invention are in thermal transfer relationship with the tobacco flavor medium, they are also separated from the tobacco flavor material by a carrier which supports the tobacco flavor medium. Such carriers should preferably be able to support the tobacco flavor medium when "rolled" into a tube or other configuration, as discussed below, should preferably be thermally stable so as to be able to withstand the temperatures produced by the permanent heaters, and should preferably also be thermally transmissive to allow the heat generated by the permanent heaters to be efficiently transferred to the tobacco flavor medium. Materials which fulfill these characteristics include paper and paper-like materials.

More preferably, the carrier of the present invention is made from a nonwoven carbon fiber mat of the type disclosed in copending, commonly-assigned U.S. patent application Ser. No. 07/943,747, filed concurrently herewith, and incorporated herein by reference in its entirety. Such mats should preferably have a thickness between about 0.05 mm and about 0.11 mm and be composed of nonwoven carbon fibers (having a basis weight in the range of from about 6 $g/m^2$ to about 12 $g/m^2$ with fiber diameters between about 7 $\mu$m and about 30 $\mu$m). The lengths of the fibers should allow the mat to withstand the tensile stresses encountered during processing. Preferably, the mats should include a binder which is suitable for use in electrical smoking articles (i.e., having acceptable subjective properties).

Tobacco flavor material which is disposed on the surface of the carrier of the present invention can be any material that liberates flavors when heated and is able to adhere to the surface of the carrier. Such materials include continuous sheets, foams, gels, dried slurries, or dried spray-deposited slurries, which may or may not contain tobacco or tobacco-derived materials, and which are more fully discussed in the above-incorporated U.S. patent application Ser. No. 07/943,747. It is desirable that the tobacco flavor material contain an aerosol precursor to deliver the tobacco flavor containing substance as an aerosol, so that when the smoker exhales the tobacco flavor containing substance, the visible condensed aerosol may mimic the appearance of cigarette smoke.

Because the tobacco flavor material of the present invention is disposed on the surface of the carrier material, its flavor delivery properties can be spatially varied to allow the flavor delivery profile from puff to puff to be selectively varied. For example, the tobacco flavor material adjacent a first heater can contain a first amount or type of flavorant, whereas the tobacco flavor material adjacent a second heater can contain a second different amount or type of flavorant. Thus, the flavor delivery to a smoker can be selectively varied or tailored by employing nonuniform tobacco flavor material profiles disposed on the surface of the carrier material. of course, this particular embodiment may require the smoker to orient the disposable unit relative to the permanent heaters, when it is inserted into the permanent cavity, if it is desired that a particular heater heat a predetermined portion of the non-uniform tobacco flavor material.

Additionally, flavor delivery can also be selectively varied in accordance with present invention by providing a controlled amount of energy to the heaters of present invention. For example, if the amount of energy delivered to the first heater (e.g., 20 Joules) is greater than the amount delivered to the second (e.g., 15 Joules), then the temperature that the first heater will achieve will be greater than that of the second. Therefore, the first heater will generate more aerosol or flavorants than the second, assuming the temperature is not high enough to cause undesirable burning of the tobacco flavor material. In this manner the generation of aerosol or flavorants can be selectively controlled by varying the amount of energy delivery from puff to puff.

Furthermore, flavor delivery can also be selectively varied in accordance with the present invention by varying the amount of energy delivered from disposable tobacco flavor unit to disposable tobacco flavor unit. For example, if the amount of energy delivered, per puff, to a first disposable unit (e.g., 20 Joules/puff) is greater than the amount delivered to a second (e.g., 15 Joules/puff), then the temperature that the first unit will achieve will be greater than that of the second. Therefore, the first unit will generate more aerosol or flavorants per puff than the second, assuming the temperature is not high enough to cause undesirable burning of the tobacco flavor material. In this manner the generation of aerosol or flavorants can be selectively controlled by varying the amount of energy delivery from unit to unit.

Residual aerosol which condenses onto the permanent heaters of the present invention can be partly removed by the wiping action of the inner part of a new tobacco flavor unit against the heaters as the new tobacco flavor unit is inserted. Thus, the insertion end of the tobacco flavor unit pushes any residues on the heater surfaces toward the ends of the heaters. For this reason, the tobacco flavor unit should be relatively firm, and the heaters should preferably have a smooth surface finish to assure that the wiping action is effective.

The parameters of the permanent heaters are chosen to allow delivery of an effective amount of tobacco flavor substance—e.g., an aerosol containing tobacco flavors—to the smoker under standard conditions of use. For example, it may be desirable to deliver 1 to 2 mg of aerosol to a smoker during a 35 ml puff having a two-second duration.

It has been found that in order to achieve such delivery, the heaters should be able to reach a temperature of between about 200° C. and about 700° C. when in thermal transfer relationship with the tobacco flavor medium. Further, the heaters should preferably consume between about 5 to 40 Joules of energy, more preferably about 10–25, and even more preferably about 20 Joules.

Heaters having such characteristics preferably have an active surface area of between about 3 $mm^2$ and about 20 $mm^2$ and preferably have a resistance of between about 0.5 Ω and about 3.0 Ω. More preferably, the heaters should have a resistance of between about 0.8 Ω and 2.1 Ω. Of course, the heater resistance will also be dictated by the particular power source that is used to provide the necessary electrical energy to heat the heaters. For example, the above heater resistances correspond to embodiments where power is supplied by four series-connected nickel-cadmium battery cells with a total power source voltage of approximately 4.8 to 5.8 volts, as discussed below. In the alternative, if six or eight such series-connected batteries are used, the heaters should preferably have a resistance of between about 3 and 5 ohms or between about 5 and 7 ohms, respectively.

The materials of which the heaters are made are preferably chosen to assure reliable repeated uses of at least 1,800 on/off cycles without failure. The heater materials are also chosen based on their reactivities, to assure that they will not react with the tobacco flavor medium at any temperature likely to be encountered to form any undesired compounds. Similarly, the heaters themselves should not evolve any undesired compounds even when heated out of the presence of the tobacco flavor medium. Alternatively, heaters that might otherwise evolve undesired compounds could be encapsulated in an inert heat-conducting material such as a suitable ceramic material.

Based on these criteria, materials for the electric heating means of the present invention include carbon, graphite, stainless steel, tantalum, metal ceramic matrices, and metal alloys, such as iron alloys, and nickel-chromium alloys. Suitable metal ceramic matrices include silicon carbide aluminum and silicon carbide titanium. Of the listed materials, stainless steel and the iron or chromium alloys should preferably be encapsulated in a suitable ceramic material because of their poor oxidation and corrosion resistance at high temperatures. Suitable ceramic materials for encapsulation include silica, alumina, and sol gels.

Most preferably, however, the electric heaters of the present invention are made from doped silicon. Such heaters are described in copending commonly-assigned U.S. patent application Ser. No. 07/943,505, filed concurrently herewith, and hereby incorporated by reference in its entirety. That application discloses electrical heaters which are made from silicon semiconductor material which is doped with phosphorous impurities to a level in the range of from about $5\times10^{18}$ impurities/cm$^3$ to about $5\times10^{19}$ impurities/cm$^3$, corresponding to a resistivity in the range of from about $1\times10^{-2}$ Ω-cm to about $1\times10^{-3}$ Ω-cm, respectively.

A first preferred embodiment of an electrical smoking article 10 according to the present invention is shown in FIGS. 1–5. Article 10 includes reusable or "permanent" portion 20 and disposable tobacco flavor unit 21 which is received in a permanent cavity 30 at the mouth end of portion 20.

Reusable portion 20 includes, at the end remote from the mouth end, a power source 22, which could include a battery, a capacitor or both. The battery could be replaceable, rechargeable or both. If the battery is rechargeable, or if the power source 22 is a capacitor alone, then article 10 is provided with charging contacts 11 on its outer surface, for connection to an external power supply (not shown) for charging power source 22. Power source 22 provides power for heating elements 23, which are energized under the control of control circuit 24, which is in turn preferably actuated by a puff-actuated sensor 24A. In the alternative, control circuit 24 is actuated by pushbutton 25. Indicators 26, which could be light-emitting diodes or other visual indicators, reflect the status of the various heaters 23. More preferably, indicators 26 comprise a seven-segment liquid crystal display capable of displaying the digits "0" through "8".

The functions of power source 22, control circuit 24, puff-actuated sensor 24A (or pushbutton 25), and indicators 26 are described in more detail below and in above-incorporated U.S. Pat. No. 5,060,671.

Portion 20 is covered by tube 31, to give it the appearance of a conventional cigarette. Tube 31 is comprised of a spiral wound two-ply tube made from heavy paper. In the alternative, tube 31 can be made from heat-resistive plastic or aluminum. Perforations 12 may be provided in the wall of portion 20 to allow outside air to be drawn in during puffing, or outside air may be drawn through all of portion 20 via openings (not shown) at its far end 13. Additionally, perforations of or other types of air pathways may be provided in portion 21 (not shown) to allow outside air to be drawn in during puffing.

In the present embodiment, heating elements 23 are linear, extending from a point slightly spaced away from the mouth end of cavity 30 to a point slightly spaced away from back-flow filter cavity 43 to be discussed below. At one of the two ends of cavity 30, all of heating elements 23 are connected in common, while at the other end each element 23 is connected separately to control circuitry 24 for individual activation of heating elements 23. Chamfered ends 40 of heating elements 23 at mouth end of cavity 30 provide a lead-in for the insertion of disposable tobacco flavor unit 21. Heating elements 23 are preferably distributed substantially uniformly around the circumference of cavity 30, and should preferably be spaced apart sufficiently that the regions of tobacco flavor unit 21 heated by neighboring heating elements 23 do not overlap, which could lead to reheating and the production of undesired compounds and off tastes.

Figure 4:
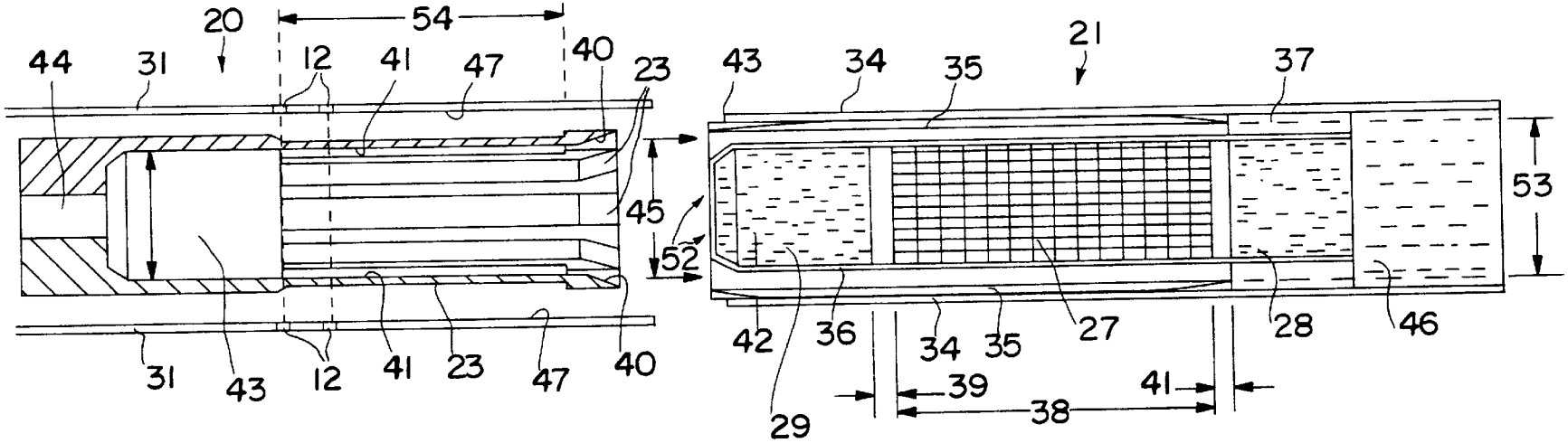
FIG. 4 is a longitudinal cross-sectional view of a "center draw" embodiment of the electrical smoking article of FIGS. 1–3A, taken from line 4—4 of FIG. 2.
Figure 5:
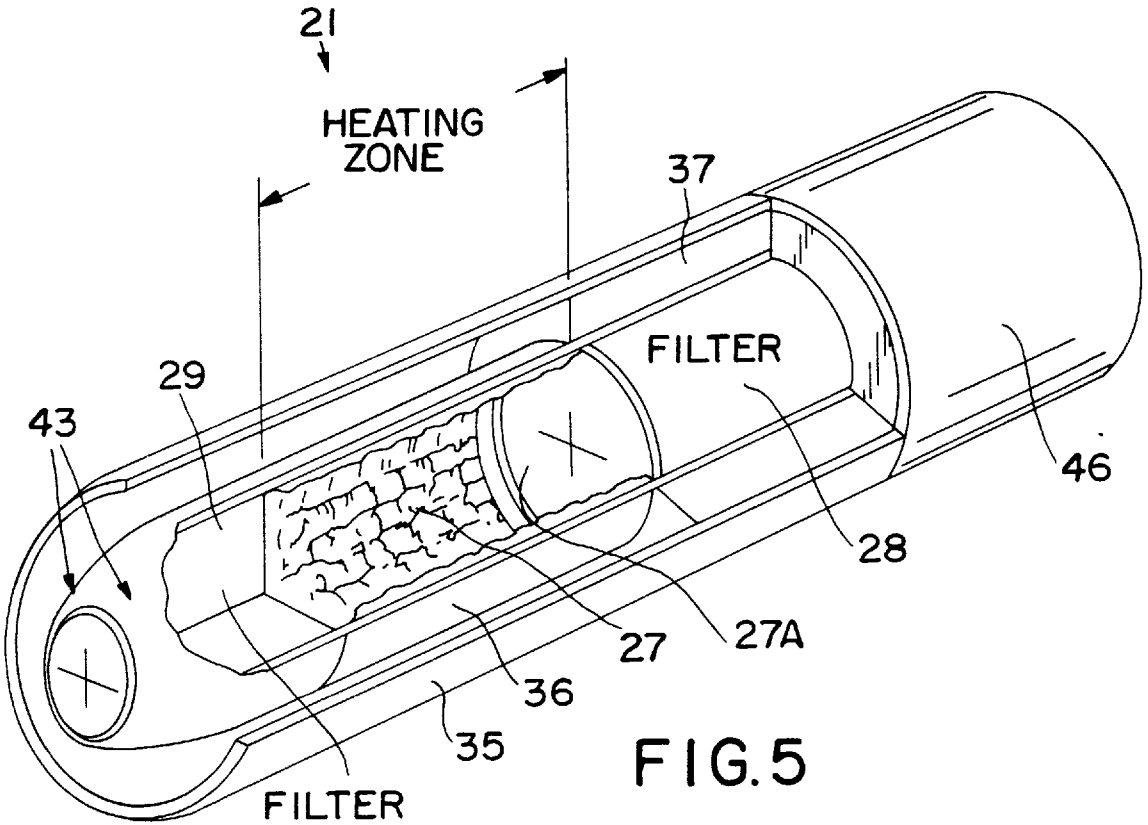
FIG. 5 is a partially fragmentary, perspective view of the disposable tobacco flavor unit of the electrical smoking article of FIGS. 1–4, taken from line 5—5 of FIG. 2.

As shown in FIGS. 4 and 5, disposable tobacco flavor unit 21 preferably includes tobacco flavor material 27 positioned on carrier 36, free-flow filter 28, back-flow filter 29, mouthpiece filter 46 and aerosol barrier tube 35. Carrier 36, in addition to attaching free-flow filter 28 to back-flow filter 29, physically separates heater elements 23 from tobacco flavor material 27.

Figure 3A:
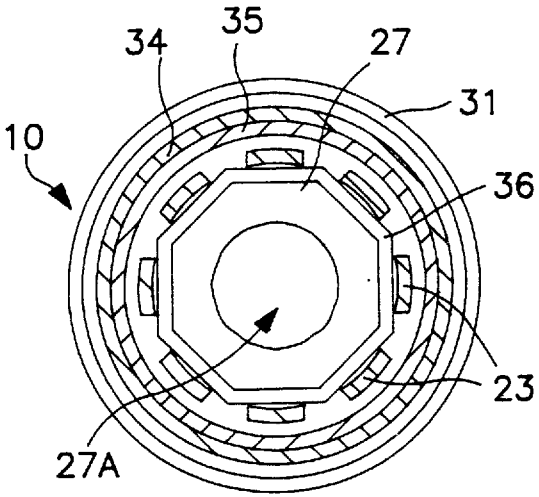
FIG. 3A is a radial cross-sectional view of the electrical smoking article of FIGS. 1–3, taken from line 3A—3A of FIG. 1.
Figure 3:
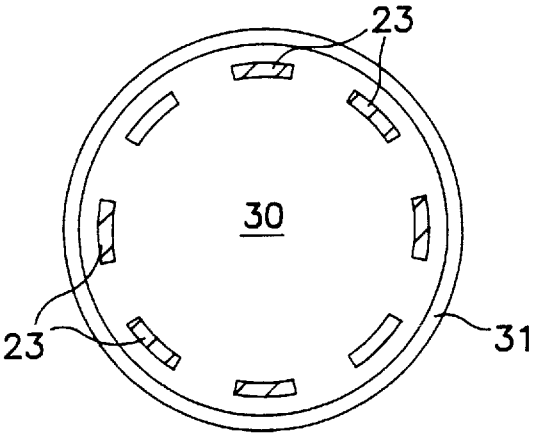
FIG. 3 is a radial cross-sectional view of the electrical smoking article of FIGS. 1 and 2, taken from line 3—3 of FIG. 2.

When tobacco flavor unit 21 is inserted in cavity 30 of reusable portion 20, aerosol barrier tube 35 fits over the outside surface 51 of heater elements 23 whereas back-flow filter 29, tobacco flavor material 27 and free-flow filter 28 fit into cavity 30, as shown in FIG. 3A. Thus, the inside surfaces 41 of heater elements 23 are adjacent tobacco flavor material 27 to facilitate aerosol generation, but are separated from it by carrier 36. Preferably, back-flow filter 29 should fit snugly into back-flow filter cavity 43 of cavity 30. The purpose of this filter is to minimize the effect of aerosol which flows backwards from air passageway and aerosol cavity 27A (see FIGS. 3A and 5) towards power source 24 of reusable portion 20 of article 10. Such back flow can result in the condensation of aerosol onto the electrical portions and other permanent structural components of article 10. Subsequent reheating of such condensation can produce undesirable flavors that may be delivered to a smoker. As shown in FIGS. 4 and 5, back-flow filter 29 is curved on its insertion end 43 in order to facilitate heater alignment upon insertion of tobacco flavor unit 21 into permanent portion 20 of article 10 before they can be delivered to the smoker.

Adjacent the mouth side of tobacco flavor material 27 is optional free-flow filter 28. The primary purpose of free-flow filter 28 is to provide structural support and facilitate attachment of carrier 36 and back-flow filter 29 to unit 21. Thus, free-flow filter 28 preferably has a low resistance-to-draw (i.e., provides for the "free-flow" of aerosol or vapor). Alternatively, if desired, a hollow tube can be provided in its place. If desired, free-flow filter 28 can be designed to provide a predetermined amount, generally small, of filtration of aerosol or vapor.

Adjacent free-flow filter 28, on the opposite side of air passageway and aerosol cavity 27A, is additional optional mouthpiece filter 46, which is provided mostly for the sake of appearance and to give article 10 a "mouth feel" similar to a conventional cigarette. According to another aspect of the present invention to be discussed below, these three filters are attached together in accordance with a method which is compatible with conventional high-volume assembly machinery. Although not shown in FIGS. 4 and 5, an air gap may be inserted between collar 37 and mouth piece filter 46 (e.g., from 2 to 10 mm) to expose more inner surface area of filter 46 to aerosol.

In accordance with the present invention, free-flow filter 28, back-flow filter 29 and carrier 36 form an air passageway and aerosol cavity 27A (see FIGS. 3A and 5) which allow for the generation and passage of aerosol to a smoker. Cavity 27A facilitates formation of aerosol by allowings pace for condensation of droplets to occur while minimizing deposition of those droplets on internal surfaces of article 10.

Tobacco flavor unit 21 also includes an aerosol barrier tube 35 which is used to prevent aerosol from condensing onto inside surface 47 of permanent portion wall 31. Since wall 31 forms a part of permanent portion 20, reducing this type of condensation further reduces the potential for the generation of undesirable flavors due to the reheating of condensed aerosol. Aerosol which does condense onto the surface of aerosol barrier tube 35 is disposed of when tobacco flavor unit 21 is discarded after use. Additionally, aerosol barrier tube 35 also prevents the build-up of condensed aerosol onto permanent portion 20 from creating undesirable staining.

Aerosol barrier tube 35 should be able to withstand the high temperatures produced by heaters 23 and should be rigid enough to allow the smoker to handle tobacco flavor unit 21 without crushing it or without misaligning center section 52 of tobacco flavor unit 21 relative to aerosol barrier tube 35. Aerosol barrier tube 35 is overwrapped with overwrap or tipping paper 34 (not shown in FIG. 5) which attaches tube 35 to mouthpiece filter 46. As shown in FIG. 5, aerosol barrier tube 35 also has a collar 37 which secures center section 52 of disposable tobacco flavor unit 21 to aerosol barrier tube 35. Preferably, collar 37 should be substantially air-tight or have a large resistance to draw so as to minimize aerosol transport through the heater region between aerosol barrier tube 35 and carrier 36. Collar 37 should also be rigid enough so that gap 42 is approximately the same distance throughout the length of tobacco flavor unit 21. This facilitates the insertion of tobacco flavor unit 21 into reusable portion 20.

In the present embodiment, outside diameter 54 of disposable tobacco flavor unit 21 (see FIG. 4) is preferably approximately 7–10 mm with a combined overall length of approximately 25–40 mm.

In accordance with another aspect of the present invention, center section 52 (which includes back-flow filter 29, tobacco flavor material 27 and free-flow filter 28) of tobacco flavor unit 21 can be fabricated preferably using a manufacturing process and apparatus disclosed herein.

Figure 6:
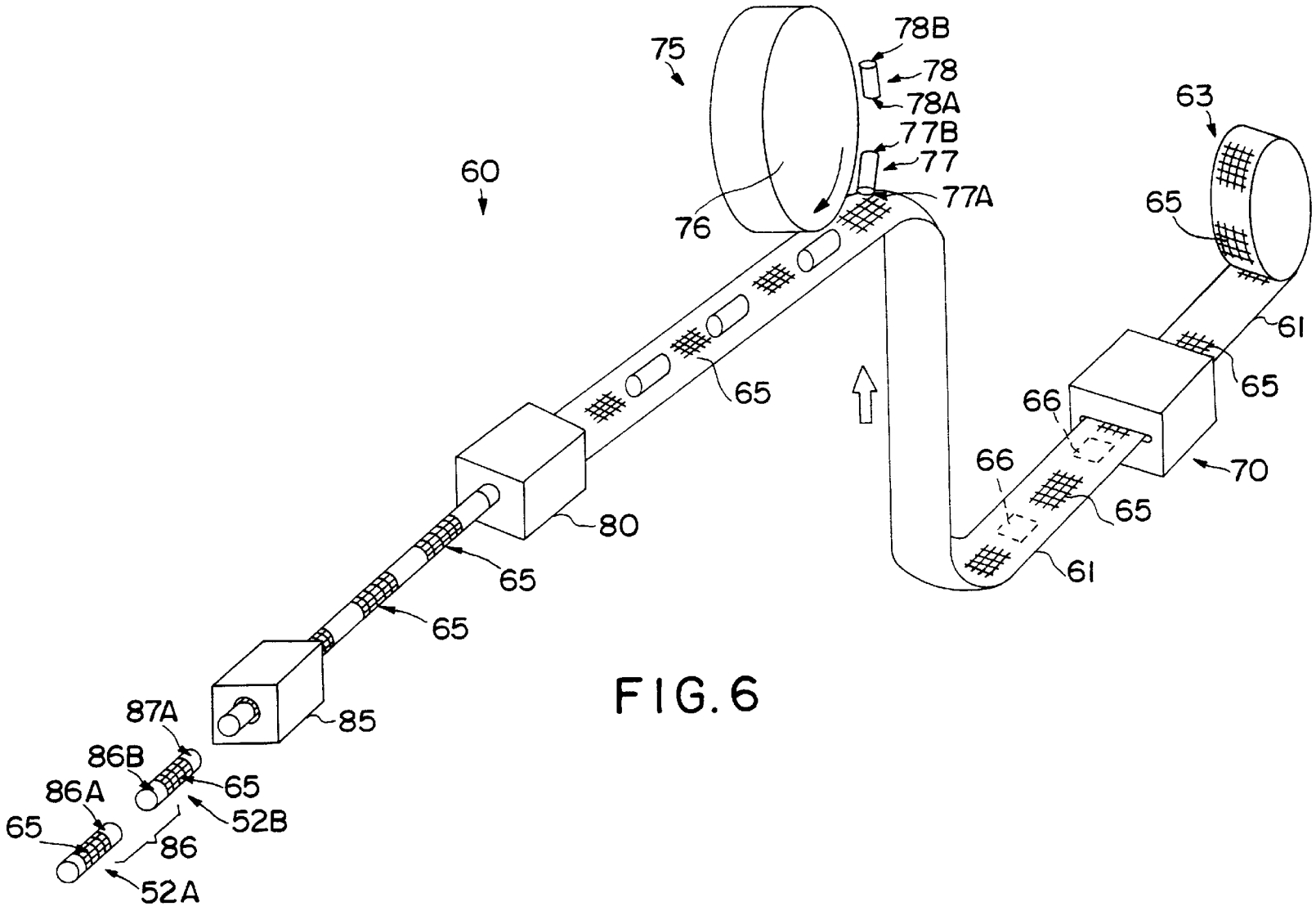
FIG. 6 is a preferred embodiment of apparatus for manufacturing the center portion of the disposable tobacco flavor unit of the electrical smoking article of FIGS. 1–5.

A preferred embodiment 60 of an apparatus for manufacturing center section 52 of disposable tobacco flavor unit 21 is shown in FIG. 6. Carrier web 61, which has a width slightly greater than the circumference of center section 52, is pulled from supply roll 62 by metering rollers (not shown). Carrier web 61 includes spaced regions 65 of tobacco flavor material which will form tobacco flavor material 27 in the final product. Spaced regions 65 can either be formed on carrier web 61 at location 63 or can be pre-formed and incorporated into supply roll 62 at another location.

Carrier web 61 then passes through a means for applying adhesive which includes adhesive-applying station 70 where a plurality of adhesive regions 66 are applied to the surface of carrier web 61.

Downstream from adhesive-applying station 70 is filter-applying station 75 which attaches back-flow filter 29 and free-flow filter 28 to adhesive regions 66 in between flavor segment regions 65 on carrier web 61. Located at filter-applying station 75 is a rotating drum-like device 76 which has filters 77 and 78 spaced alternately about its circumference. Filters 77 and 78 are spaced at a distance which corresponds to the desired spacing between back-flow and free-flow filters 29, 28 on the finished tobacco flavor unit 21.

The rotation speed of drum-like device 76 is synchronized with that of the downstream motion of carrier web 61 so that filters 77 and 78 are placed on carrier web 61 at appropriate positions in between flavor segment regions 65. Each filter 77, 78, respectively, has down-stream sides 77A, 78A and up-stream sides 77B, 78B.

Downstream from filter-attaching station 75 is a paper wrapping station 80 where carrier web 61 is wrapped around the filters and tobacco flavor portions to form a completed continuous "rod" of alternating regions of flavor segments and filter segments. After the completed continuous "rod" is formed, it is subsequently severed at severing station 85 to form the finished center component of tobacco flavor unit 21. At severing station 85, filters 77 and 78 will be severed approximately half way in between their upstream and downstream sides in order to complete the fabrication process for the center section 52 of disposable tobacco flavor unit 21. Thus, at severing station 85, filter 86 is severed into two portions 86A and 86B, each forming part of a respective center section 52A, 52B.

After severing, each individual center section 52A, 52B (collectively 52) of tobacco flavor unit 21 is inserted into an aerosol barrier tube that has a collar which secures the center section to the aerosol barrier tube (see FIG. 5).

After severing and preferably before insertion into an aerosol barrier tube, one end of each individual center section can be further processed, if desired, to provide a curved insertion end 43 (see FIG. 5) in order to facilitate heater alignment upon insertion of tobacco flavor unit 21 into permanent portion 20 of article 10.

Additionally, if it is desired that freeflow and back-flow filters be composed of different filtering materials, the filters 77 and 78 can be made respectively from free-flow filter material and back-flow filter material. When filters 77, 78 are attached to adhesive regions 66, the result is repeated regions of: free-flow filter material, tobacco flavor material, and back-flow filter material. Under these conditions, each of filter portions 86A and 86B would form either a free-flow filter or back-flow filter depending upon the composition of filter 86 (see FIG. 5). Of course, in such a case, it will be necessary to reorient every other center section 52A or 52B, either before or after inserting into an aerosol barrier tube, if it is desired that all center sections 52 be oriented in the same direction for subsequent processing.

Although FIG. 6 shows carrier web 61 having "spaced" regions 65 of tobacco flavor material, with adhesive regions 66 applied in between spaced regions 65, in an alternative embodiment of the present invention the tobacco flavor material can be "continuous" on carrier web 61. For this embodiment, adhesive regions 66 could be periodically spaced on top of the continuous tobacco flavor material so as to still allow filter-applying station 75 to periodically attach back-flow and free-flow filters. The portion of the tobacco flavor material covered by the filters would not be adjacent the heaters when the unit is incorporated into an electrical smoking article and thus would not contribute to flavor generation when the heaters are activated.

The above-described embodiment of electrical smoking article 10 shown in FIGS. 1–5 is arranged so that tobacco flavor unit 21 has air passageway and aerosol cavity 27A disposed within a space bounded by the heater elements so as to provide a "center draw" embodiment of an electrical smoking article. A second embodiment of the present invention is arranged so that the air passageway and aerosol cavity are outside the space bounded by the heater elements so as to provide a "peripheral draw" article. That second embodiment of the present invention is shown in FIGS. 7–9.

Figure 7:
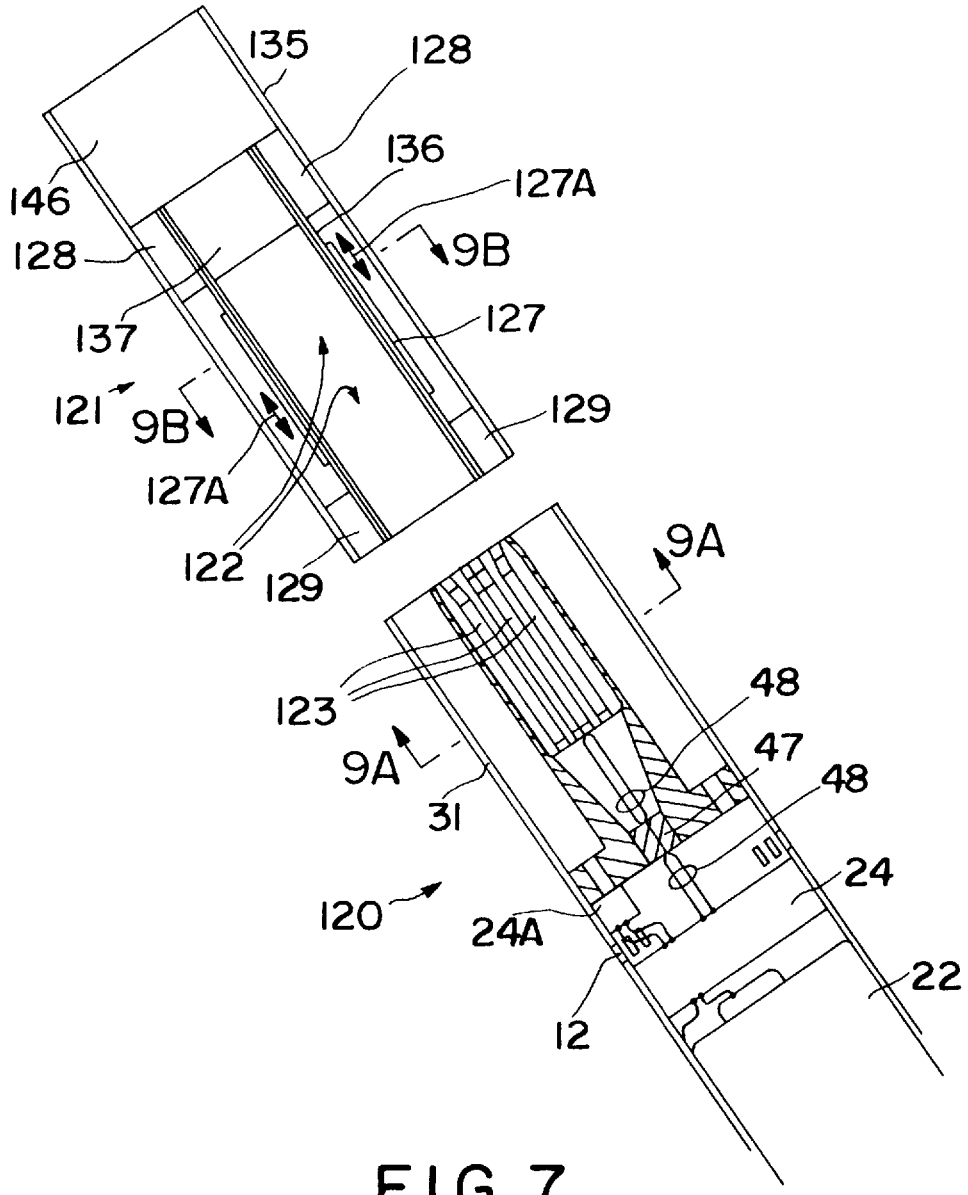
FIG. 7 is a longitudinal cross-sectional view similar to FIG. 4 but for a "peripheral draw" embodiment of the present invention.
Figure 8:
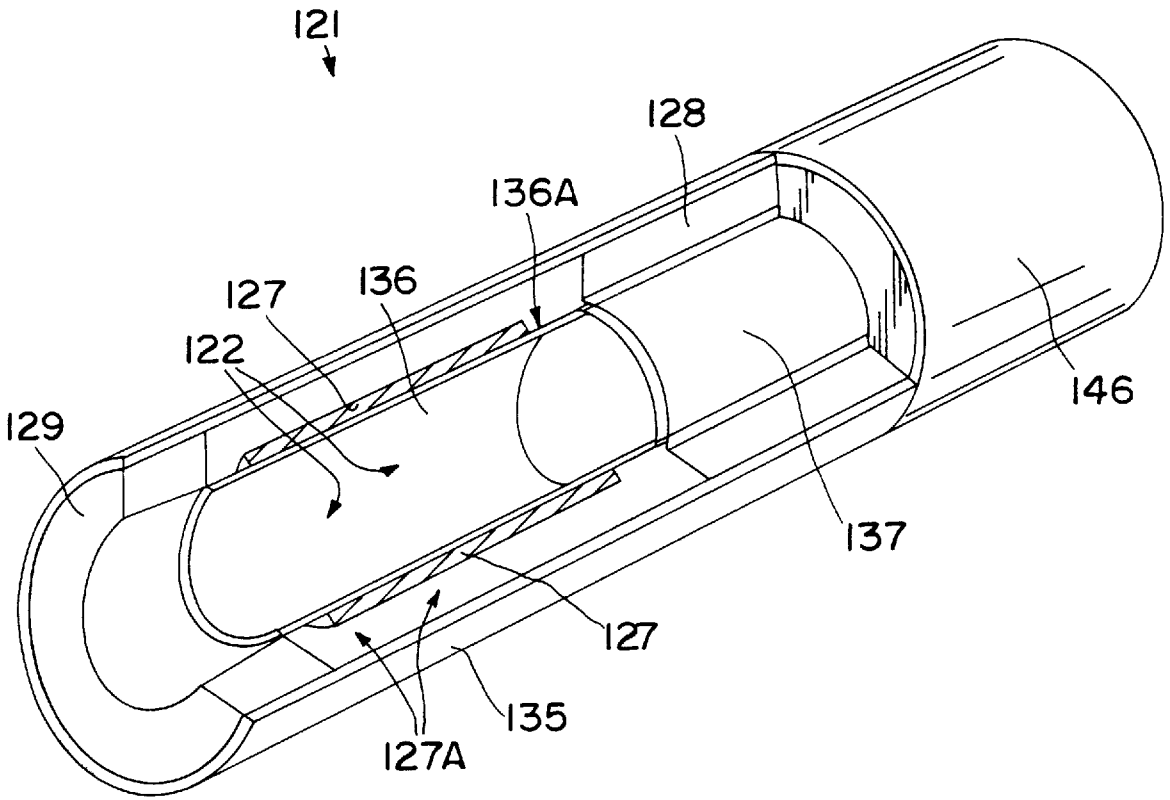
FIG. 8 is a partially fragmentary, perspective view of the disposable tobacco flavor unit of the electrical smoking article of FIG. 7.
Figure 9C:
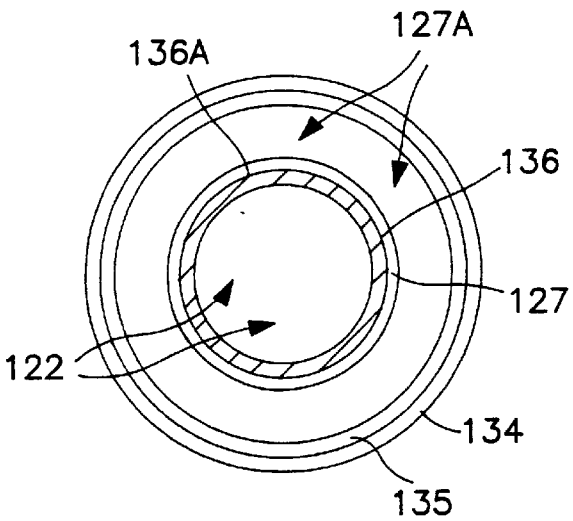
FIG. 9C is a radial cross-sectional view of the electrical smoking article of FIGS. 7 and 8, taken from line 9B—9B of FIG. 7 after the disposable tobacco flavor unit is inserted into the permanent heater portion of the electrical smoking article.
Figure 9B:
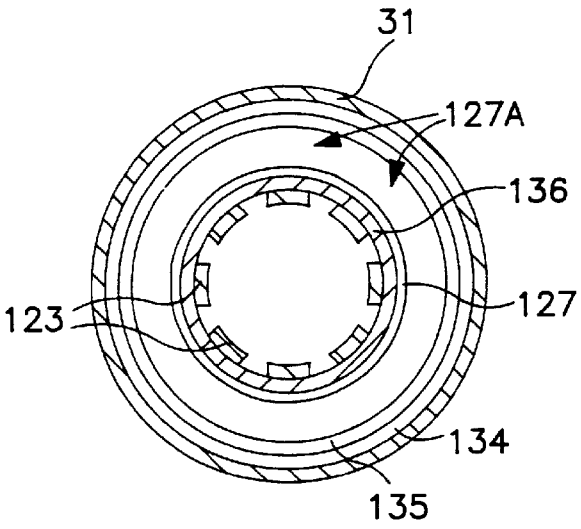
FIG. 9B is a radial cross-sectional view of the electrical smoking article of FIGS. 7 and 8, taken from line 9B—9B of FIG. 7.
Figure 9A:
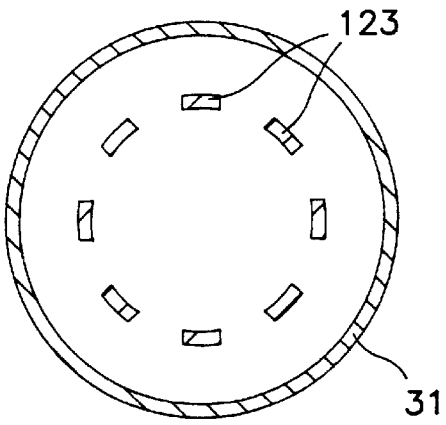
FIG. 9A is a radial cross-sectional view of the electrical smoking article of FIGS. 7 and 8, taken from line 9A—9A of FIG. 7.

The "peripheral draw" embodiment of the electrical smoking article shown in FIGS. 7–9 includes permanent heater portion 120 and disposable tobacco flavor unit 121. For the present embodiment, plurality of heaters 123 are arranged so that they fit into cavity 122 of unit 121. Plurality of heaters 123 are used to heat tobacco flavor material 127 positioned on outside surface 136A of carrier 136 corresponding to carrier 36 in the "center draw" embodiment of the present invention discussed above (FIGS. 1–5).

Disposable tobacco flavor unit 121 includes aerosol barrier tube 135, isolation barrier 136, plug 137, tobacco flavor material 127, free-flow filter 128, back-flow filter 129 and mouthpiece filter 146, as in the "center draw" embodiment of the present invention, but modified accordingly to permit "peripheral draw." Free-flow filter 146, back-flow filter 129 and isolation barrier 136 again define an air passageway and cavity 127A which is used to generate and confine aerosol and allow it to flow through free-flow filter 128. Plugs 137 and 47 are air-tight, or large resistance to draw, plugs which minimize aerosol transport through the heater regions of the article. Plugs 137 and 47 can be fabricated out of a densely packed cellulose acetate or a solid core of paper-based material. Plug 47 includes an air-tight hole (not shown) which allows heating wires 48 to pass from control circuit 24 to heating elements 123.

Back-flow filter 129 serves the same purpose as back-flow filter 29 in the "center draw" embodiment of the present invention (i.e., prevent the back flow of aerosol). In addition, however, it also functions to give rigidity to disposable tobacco flavor unit 121 and to keep isolation barrier 136 properly spaced and aligned to allow plurality of heaters 123 to uniformly contact the surface of isolation barrier 136. Free-flow filter 128 and back-flow filter 129 are composed of the same materials as free-flow filter 28 and back-flow filter 29, respectively, in the "center-draw" embodiment of the present invention.

Figure 10:
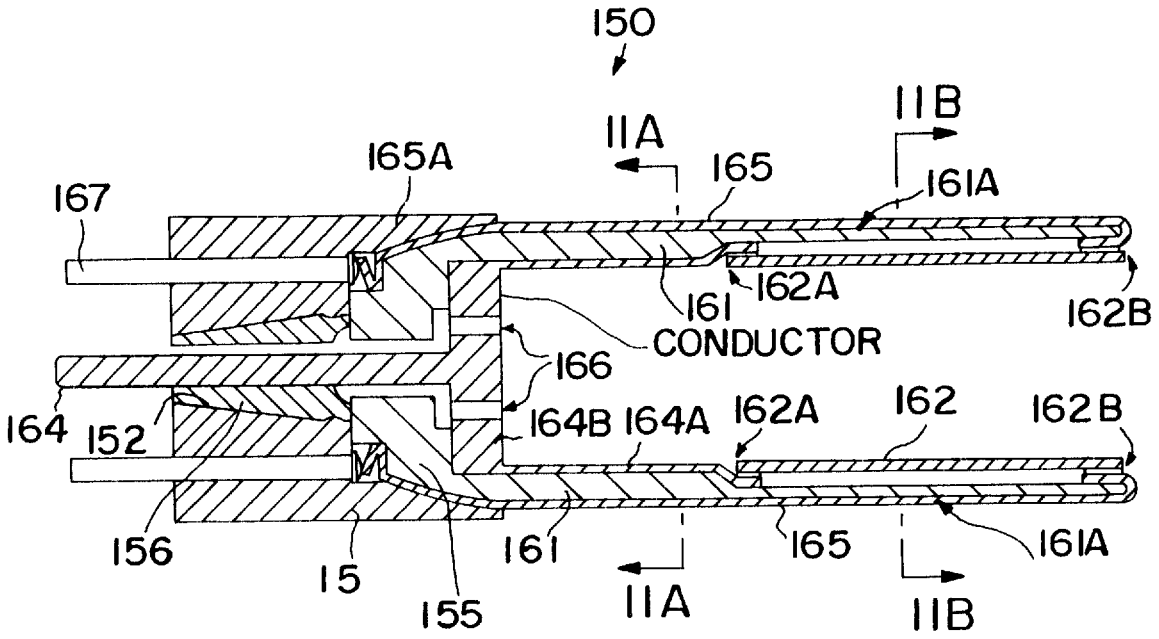
FIG. 10 is a longitudinal cross-sectional view of the preferred embodiment of a permanent heater unit for the "center draw" embodiment of the present invention.
Figure 11B:
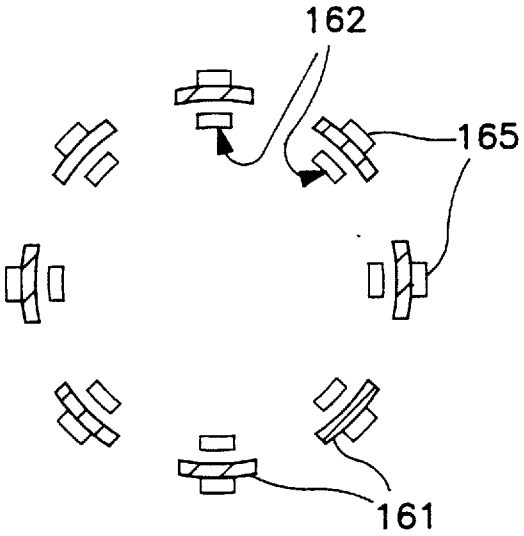
FIG. 11B is a radial cross-sectional view of the permanent heater unit of FIG. 10, taken from line 11B—11B of FIG. 10.
Figure 11A:
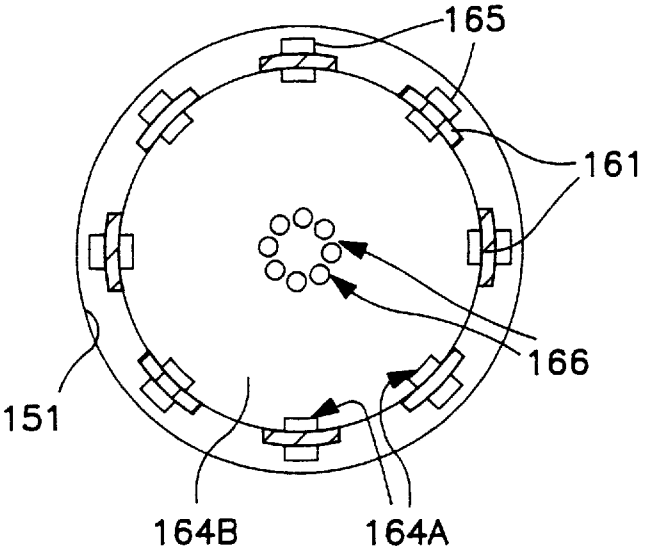
FIG. 11A is a radial cross-sectional view of the permanent heater unit of FIG. 10, taken from line 11A—11A of FIG. 10.

FIGS. 10 and 11 show a preferred embodiment of the "center draw" permanent heaters of the present invention. Permanent heater unit 150 shown in FIGS. 10 and 11 includes heater base 151, heater support 155 and plurality of heater support arms 161, all made from thermally-stable electrically insulating material. Heater unit 150 also includes plurality of heaters 162 mounted on heater support arms 161.

For the present embodiment, heaters 162 are electrically contacted at opposite ends 162A and 162B, by conducting fingers 164 and conducting fingers 165, respectively. Heater ends 162A are all electrically connected together to form the "common" of the electrical heater system. Common terminal 164 connects to conducting plate 164B which, in turn, is connected to common fingers 164A to provide for electrical contact to heater ends 162A. Plate 164B contains plurality of holes 166 for allowing aerosol to pass through for delivery to the smoker.

Conductor fingers 165, which run along the outer edge 161A of heater support arms 161, are used to individually contact heater ends 162B. Additionally, conductor fingers 165 have bends 165A in order to facilitate electrical contact to individual terminals 167 which extend down through base 151 and provide for individual activation of heaters 162. In accordance with the present embodiment, heater support 155 "snap fits" into heater base 151 by inserting heater neck 156 into base collar 152, which thus provides for continuous electrical contact between connectors 167 and ends 162B of heaters 162. The "snap fit" design of the present embodiment allows for ease of manufacture and allows for large insertion pressures to be exerted onto connectors 167 by bends 165A to provide for small and consistent electrical contact resistances. Additionally, it allows heaters 162 to be removed from heater base 151 for replacement, if desired.

In accordance with the present invention, power source 22 shown in FIG. 2 preferably must be able to deliver sufficient energy to generate or release flavors or other components in vapor or aerosol form from eight "respective fractions" of tobacco flavor medium, while still fitting conveniently in the article. However, the energy to be delivered is not the only criterion, because the rate at which that energy is delivered—i.e., the power—is also important. A preferred power source is four series-connected N50-AAA CADNICA nickel-cadmium cells produced by Sanyo Electric Company, Ltd., of Japan. These batteries provide approximately 1.2 to 1.45 volts per cell, for a total of approximately 4.8 to 5.8 volts when four such batteries are connected in series. Of course, other power sources can be used as well.

Figure 12:
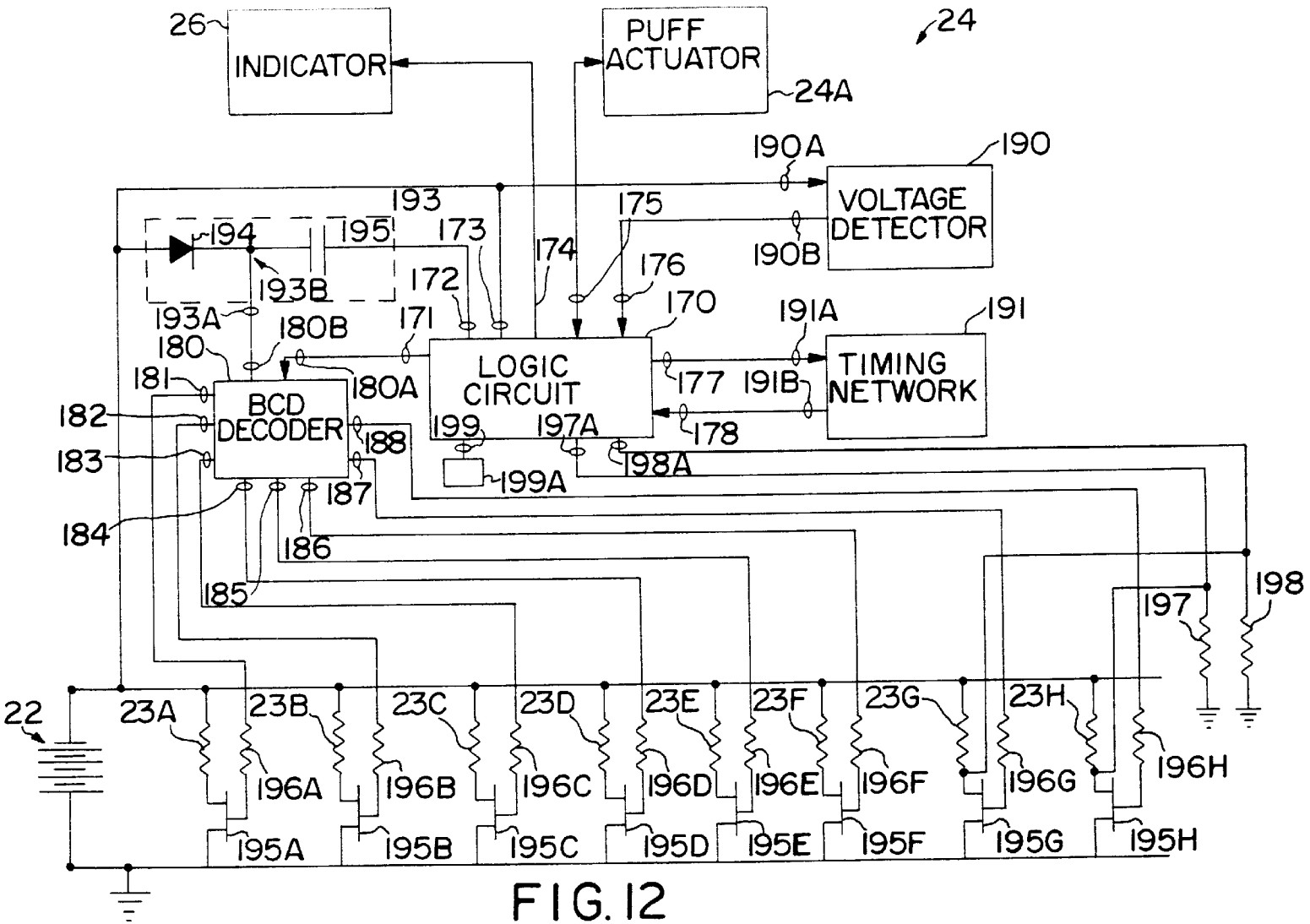
FIG. 12 is a schematic diagram of a preferred embodiment of a control circuit for use in the present invention.

The most preferred embodiment of the present invention includes control circuit 24 of FIG. 12. Control circuit 24 preferably fulfills several functions. It preferably sequences through the eight (or other number of) heaters 23 to select the next available heater 23 each time puff-actuated sensor 24A is activated. It preferably applies current to the selected heater for a predetermined duration that is long enough to produce sufficient tobacco flavor substance for an average puff, but not so long that the tobacco flavor medium can begin to burn. It preferably controls indicator 26 which indicates: (1) how much of the article (e.g., how many puffs) remains, (2) whether the voltage of power source 22 is out of range, (3) whether there is no tobacco flavor unit loaded into the article, and (4) whether there is no heater fixture loaded into the article (e.g., for the embodiment shown in FIG. 10, heater support 155 is not snap-fitted into heater base 151).

Control circuit 24 also controls the total amount of energy that power source 22 delivers to each heater. Because the voltage supplied by power source 22 can vary from puff to puff, if each heater were activated for the same period of time, then the power and energy delivered by power source 22 would generally vary from puff to puff. In accordance with the present invention, control 24 provides for the delivery of constant energy for each individual puff.

For example, in order to deliver constant energy, control circuit 24 monitors the loaded voltage of power source 22 while a heater is being activated and continues to supply power to the heater until approximately 20 Joules of energy are delivered. Thus, for a 1.2 Ω heater and a loaded voltage of 4.8 volts (i.e., four type N50-AAA CADNICA nickel-cadmium cells are connected in series), control circuit 24 will supply power to the heater for a predetermined time period of approximately 1 second. Accordingly, if the loaded voltage were only 4.0 volts, power would be supplied for a predetermined time period of approximately 1.6 seconds to accommodate the lower voltage.

As shown in FIG. 12, control circuit 24 includes logic circuit 170, BCD decoder 180, voltage detector 190, timing network 191, puff actuator 24A, indicator 26 and charge pump circuit 193. Logic circuit 170 could be any conventional circuit that can implement the functions discussed herein, such as a field-programmable logic array (e.g., a type ACTEL A1010A FPGA PL44C, available from Actel Corporation, of Sunnyvale, Calif.) programmed to perform such functions. Preferably, logic circuit 170 is operated at low clock cycles (e.g., 33 kHz) in order to conserve energy.

As shown in FIG. 12, each heater 23A–23H is connected to the positive terminal of power source 22 and to ground through a respective field-effect transistor (FET) 195A–195H. A particular FET 195A–195H will turn on under control of BCD-to-decimal decoder 180 (preferably a standard type CD4514B 4 to 16 line decoder) through terminals 181–188, respectively. BCD decoder 180 receives two types of signals through control terminal 180A from logic circuit 170: 1) the BCD code of the particular heater 23A–23H to be activated, and 2) the ON and OFF signals for activating that heater.

BCD decoder 180 is connected, through terminal 180B, to terminal 193A of charge pump circuit 193 which provides the voltage which is used to drive the gates of each FET 195A–195H. Charge pump circuit 193 includes diode 194, coupled to power source 22, and capacitor 195, coupled to logic circuit 170. Logic circuit 170 includes a conventional switching network (not separately shown) coupled to terminal 172 which allows for the voltage at terminal 193B of charge pump circuit 193 to be boosted to preferably approximately twice that of power source 22. Diode 194 prevents such voltage from coupling back to power source 22. Thus, the doubled voltage at terminal 180B of decoder 180 is used to drive the gates of FETs 195A–195H at enhanced voltage levels in order to increase the efficiency of control circuit 24. Resistors 196A–196H coupled in series with the gates of FETs 195A–195H are provided to increase the charging time of the respective gates in order to reduce the generation of high frequency harmonics which could produce noise in control circuit 24.

Puff actuator 24A supplies a signal to logic circuit 170 that is indicative of smoker activation (i.e., a continuous drop in pressure of approximately one inch of water). Thus, puff actuator 24A can be composed of a piezoresistive pressure sensor that is used to drive an operational amplifier, the output of which in turn is used to supply a logic signal to logic circuit 170. For example, the pressure sensor can be a type NPH-5-002.5G NOVA sensor, available from Lucus-Nova, of Freemont, Calif. or a type QLT004D sensor, available from SenSym Incorporated, of Sunnyvale, Calif.

In order to conserve energy, it is preferred that puff actuator 24A is cycled on and off at low duty cycles (e.g., from about a 2 to 10% duty cycle). For example, it is preferred that puff actuator 24A is turned on only for about a 0.5 ms time period every 16 ms. This modulation technique reduces the time average current required by puff actuator 24A and thus can extend the lifetime of power source 22.

Timing network 191 is used to provide a shut-off signal to logic circuit 170 after an individual heater 23A–23H has been activated for a predetermined time period, depending upon the amount of energy that is delivered to a heater. In accordance with the present invention, it is preferred that each heater 23A–23H is activated for a period of time so that a constant amount of energy (e.g., in a range from about 5 to 40 Joules, or more preferably, about 15 to 25 Joules) is supplied to each heater, independent of the loaded voltage of power source 22. Thus, terminal 191A provides to timing network 191 information about the turn-on time of each heater 23 and the loaded voltage of power source 22, assuming that the heater resistance is known and constant (i.e., 1.2 Ω). Terminal 191B then supplies a shut-off signal to terminal 178 of logic circuit 170 indicative of a time period corresponding to the delivery of a constant amount of energy.

Figure 13:
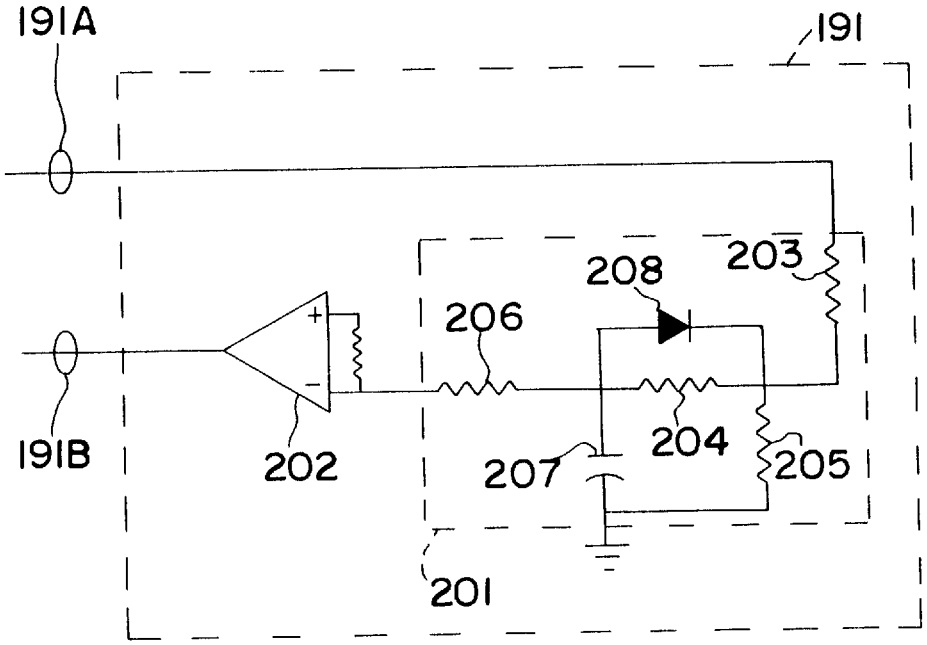
FIG. 13 is a schematic diagram of a preferred embodiment of the timing network of the control circuit of FIG. 12.

A preferred embodiment of timing network 191 is shown in FIG. 13. Timing network 191 includes terminal 191A which receives a signal from logic circuit 170 that changes from approximately zero volts to the loaded battery voltage level at the time of initial activation of an individual heater 23A–23H. This signal is filtered through resistor-capacitor network 201 (including resistors 203–206, capacitor 207 and diode 208) and is used to drive over-voltage detector 202. over-voltage detector 202 is preferably a type ICL7665A over/under-voltage detector available from Maxim Corporation, of Sunnyvale, Calif. In accordance with the present invention, resistor capacitor network 201 is chosen so that terminal 191B of timing network 191 changes from a HIGH state to a LOW state at the time the predetermined constant amount of energy is delivered to each heater. Of course, other timing network circuit configurations could just as well be used.

If desired, control circuit 24 could put a maximum time limit on the time period for delivering the constant amount of energy. For example, if the voltage of power source 22 is so low that it would take longer than 2 seconds to deliver 20 Joules of energy, then logic circuit 170 could provide an automatic shut-off signal at terminal 171 after a heater has been ON for 2 seconds even though 20 Joules of energy have not been delivered.

In an alternative embodiment of the present invention, timing network 191 could be used to provide a shut-off signal to logic circuit 170 for a predetermined time period independent of energy delivery. Thus, timing network 191 could provide a shut-off signal after, for example, a fixed time period in the range from about 0.5 second to 5 seconds.

Voltage detector 190 is used to monitor the voltage of power source 22 and provide a signal to logic circuit 170 when that voltage is either (1) lower than a first predetermined voltage (e.g., 3.2 volts) which indicates that the power source must be recharged, or (2) higher than a second predetermined voltage (e.g., 5.5 volts) which indicates that the power source has been fully recharged after the voltage has fallen below the first predetermined voltage level. Voltage detector 190 is preferably a type ICL7665A over/under-voltage detector available from Maxim Corporation, of Sunnyvale, Calif.

As discussed above, logic circuit 170 is used to control BCD decoder 180 through terminal 171. Logic circuit 170 also controls indicator 26 which is used to indicate the number of puffs available to the user and which preferably is a single-digit seven segment liquid crystal display (LCD) for an eight-puff article. Thus, for a newly-inserted tobacco flavor unit having eight respective fractions of tobacco flavor material, indicator 26 would display an "8", whereas for a tobacco flavor unit with "one" puff left, indicator 26 would display a "1". After the last puff has been used, indicator 26 displays a "0".

Additionally, indicator 26 displays a "0" when either there is no tobacco flavor unit or heater fixture loaded into the article. Furthermore, to indicate that the power source voltage is out of range, i.e., has fallen below the recharge level (e.g., 3.2 volts) or has not been fully recharged after the voltage has fallen below the recharge level, indicator 26 is repetitively cycled on and off at a frequency of 0.5 Hertz. For example, if immediately after the first puff the power source voltage falls below 3.2 volts, indicator 26 blinks a "7" display twice per second.

Logic circuit 170 determines, through terminals 197A and 198A, whether a heater fixture is loaded in the smoking article by measuring the respective voltage drops across high-resistance resistors 197 and 198 (e.g., 1 MΩ), respectively. Resistors 197 and 198 each have one terminal permanently connected to the drains of FETs 195G and 195H, respectively, and a second terminal coupled to ground. When no heater is loaded into the smoking article, the heaters identified by reference numerals 23G and 23H in FIG. 12 are disconnected from the drains of FETs 195G and 195H, respectively. Thus, power source 22 will also be disconnected from the drains of FETs 195G and 195H. As a result, no voltage will be produced across resistors 197 and 198, which are in turn monitored by logic circuit 170 through terminals 197A and 198A, respectively. Therefore, when no heater fixture is loaded in the smoking article, logic circuit 170 will detect two "zeros" at terminals 197A and 198A.

While a heater fixture is loaded in the electrical smoking article, power source 22 will be coupled to resistors 197 and 198 through heaters 23G and 23H, respectively. As a result, a voltage will be produced across resistors 197 and 198 and logic circuit 170 will therefore typically detect two "ones" at terminals 197A and 198A. Logic circuit 170 monitors two resistors (i.e., resistors 197 and 198) because if either of FETs 195G and 195H is turned ON to activate its respective heater, the respective resistor 197 or 198 becomes essentially shorted to ground. As a result, it is possible that, even with a heater fixture loaded, an erroneous indication that it was not loaded could be produced if only one resistor were used. However, if two resistors are used, then, for example, while FET 195G is on, the voltage across resistor 197 will be close to zero and the voltage across resistor 198 will be indicative of a logical "one," and while FET 195H is on, the voltage across resistor 198 will be close to zero and the voltage across resistor 197 will be indicative of a logical "one." Therefore, two resistors 197, 198 are used, and the respective signals from resistors 197 and 198 are logically ORed together by logic circuit 170 to determine if a heater fixture is loaded in the electrical smoking article.

In order to determine whether a tobacco flavor unit is loaded in the smoking article, logic circuit 170 includes an additional terminal 199 that receives a signal whenever a tobacco flavor unit is physically present in the smoking article. The signal at terminal 199 can be produced by a conventional switch 199A which is mechanically and electrically activated by the presence of a tobacco flavor unit. However, if the tobacco flavor unit includes the carbon fiber mat of the present invention discussed above, it is preferable that the signal at terminal 199 be produced by connecting a single electrical probe directly to the carbon mat to monitor electrical currents that leak through the mat. Since the carbon mat is not perfectly insulating, if a heater, which has one of its terminals connected to power source 22 as in FIG. 12, is brought into contact with the carbon mat of the present invention, some electrical current will leak into the carbon mat, whether or not FETs 195A–195H are activated. In accordance with the present invention such leakage current can be monitored by an electrical probe connected directly to the carbon mat in order to detect the presence of a tobacco flavor unit.

In addition to using electrical conduction through the carbon mat to determine whether a tobacco flavor unit is loaded into the electrical smoking article, such conduction can also be used, if desired, to determine the presence of particular types of tobacco flavor units (e.g., a type X tobacco flavor unit, as opposed to a type Y tobacco flavor unit). In accordance with this feature of the present invention, logic circuit 170 could be used to determine the resistivity of a carbon mat by employing two additional terminals (not shown) which contact the carbon mat in a spaced-apart relationship. By manufacturing a particular type of carbon mat to have a preselected resistivity within a preselected range (i.e., by varying the type and amount of carbon fibers and/or binder included therein), uniquely corresponding to the particular type of tobacco flavor unit, a resistivity measurement could be used to distinguish between various types of tobacco flavor units that can be inserted into an electrical smoking article. This information could then be used by logic circuit 170 to provide preselected electrical energy delivery profiles.

For example, a first type or brand of tobacco flavor unit can be manufactured with a carbon mat having a first preselected resistivity, whereas a second type or brand of tobacco flavor unit can be manufactured with a second yet different preselected resistivity. Thus, if logic circuit 170 is capable of determining the resistivity associated with an inserted tobacco flavor unit, in situ, then such a measurement can be used to actively control the application of electrical energy to the heaters of the smoking article.

In accordance with the above feature of the present invention, the delivery conditions of electrical energy can then be varied depending upon the particular type or brand of tobacco flavor unit determined to be present in the electrical smoking article. For example, after logic circuit 170 determines the resistivity associated with a particular tobacco flavor unit, logic circuit 170 could be constructed to supply either 15 Joules or 20 Joules of energy, depending upon the measured resistivity. Furthermore, logic circuit 170 could also include circuitry to prevent the delivery of any electrical energy, if it is determined that the resistivity corresponding to a particular tobacco flavor unit is not compatible with the particular electrical smoking article in which it has been inserted.

Referring back to FIG. 12, prior to a smoker taking the initial puff, indicator 26 displays, for example, an "8" indicating that eight puffs are available. Accordingly, logic circuit 170 would put the address of the first heater (e.g., heater 23A) on terminal 171 so that BCD decoder 180 would select that heater (e.g., through terminal 181) for firing upon smoker activation. When the smoker takes a puff, puff actuator 24A sends a HIGH signal through terminal 175 to logic circuit 170 indicating that the pressure in the electrical smoking article has fallen, e.g., by at least 1 inch of water. At that point, logic circuit 170 sends a signal through terminal 171 to indicate to BCD decoder 180 that FET 195A for the first heater should be turned ON. Thereafter, the voltage at terminal 180B of BCD decoder 180 is coupled by BCD decoder 180 to the gate of the first FET 195A, in order to turn the heater ON.

Simultaneously with the start of activation of the first heater 23A, timing network 191 keeps track of the instantaneous total amount of energy that has been delivered to the heater and provides a logic signal to logic circuit 170, through terminal 178, at the instant of time when that amount reaches a predetermined amount (e.g., 20 Joules). Thereafter, logic circuit 171 sends an OFF signal through terminal 171 to BCD decoder 180 which, in response, causes heater 23A to turn OFF.

Thereafter, while waiting for the smoker to take a second puff, logic circuit 170 sends the address of the second heater (e.g., 23B) to BCD decoder 180, through terminal 171, so that second FET 195B is activated during the next puff by the smoker. Also, logic circuit 170 sends a signal to indicator 26 to display a "7", indicating to the smoker that there are seven puffs left.

If desired, logic circuit 170 can also include timing circuitry to prevent the smoker from taking the next puff within a predetermined period of time so as to allow the power source to recover. For example, logic circuit 170 can include a circuit (not separately shown) which prevents an ON signal from being sent to BCD decoder 180 through terminal 171 for a disabling period of 6 seconds after the last OFF signal was sent to BCD decoder 180. If desired, to indicate to the smoker that the smoking article is in such a disabled mode, indicator 26 can be repetitively cycled on an off at a frequency of, for example, 4 Hertz (i.e., at a rate different than the rate used to indicate to the smoker that the power source voltage is out of range).

Whether or not the electrical smoking article incorporates the above puff disabling feature or the disabling indicator feature, when the smoker takes a second puff of the smoking article (after the predetermined disabling time, if applicable), control circuit 24 repeats the above steps used to activate the first heater.

The above cycle will then repeat until the final heater has been heated. At such time, logic circuit 170 (1) sends a signal to indicator 26 to cause a blank display and (2) prevents further activation of any heater until a new disposable tobacco flavor unit has been inserted into the smoking article.

Although control circuit 24 of FIG. 12 shows logic circuit 170, BCD decoder 180, voltage detector 190 and timing network 191 as individual and discrete circuits, it will be apparent that their functions could just as well be incorporated into a single integrated network (e.g., a single integrated circuit chip).

If desired, a disposable tobacco flavor unit of the present invention can include a means for indicating to a smoker that it has already been previously inserted into an electrical smoking article and subsequently removed.

For example, an unused tobacco flavor unit could include a removable "tear strip" or other means which must first be removed or disengaged from the tobacco flavor unit before the unit can be inserted into a smoking article. As such, a previously-used tobacco flavor unit will no longer have an associated tear strip or other similar means attached thereto. In the alternative, an unused tobacco flavor unit could include a physically-alterable region thereon which becomes torn, ripped, compressed or otherwise physically altered upon insertion into a smoking article. As such, a smoker will be able to determine whether such a tobacco flavor unit has been previously inserted into a smoking article by visually observing the physically-alterable region.

Furthermore, if desired, a disposable tobacco flavor unit could also include a means for indicating to a smoker that a particular tobacco flavor unit has already been heated to generate and deliver its tobacco flavor substance.

For example, a tobacco flavor unit can include a thermally-sensitive indication region which changes color to indicate to the smoker that the tobacco flavor unit has already been heated. In the alternative, the thermally-sensitive indication region can include a fusable strip which melts, open circuits, or otherwise physically changes shape, to indicate to the smoker that the tobacco flavor unit has already been heated. Of course, many other thermally-activated means could also be used to indicate that a tobacco flavor unit has already been heated. Furthermore, it will be apparent that many other electrically or mechanically-activated means could be used to accomplish the same purpose—i.e., indicate to the smoker that a tobacco flavor unit has already been heated.

Thus it is seen that an electrically-heated smoking article is provided in which the heating elements are reusable, and of which the volume of disposable portions is thereby minimized. The tobacco flavor units can be fabricated by a manufacturing process that use high-volume assembly machinery. Additionally, undesirable subjective generation from aerosol that settles or condenses onto the heating elements and other permanent structural components of the article is minimized. One skilled in the art will appreciate that the present invention can be practiced by other than the described embodiments, which are presented for purposes of illustration and not of limitation, and the present invention is limited only by the claims which follow.

What is claimed is:

1. A smoking article for delivering to a smoker a tobacco flavor substance, said article comprising:

a plurality of electrical heating elements disposed along a permanent cavity;

a source of electrical energy for powering said plurality of electrical heating elements;

control means for applying said electrical energy to said electrical heating elements to selectively heat at least one of said plurality of electrical heating elements; and a removable tobacco flavor unit comprising:

a carrier having a first end and a second end and having a first surface and a second surface, the first surface defining a flavorant cavity located between said first end and said second end, wherein the second surface is disposed adjacent the plurality of electrical heating elements;

a filter operative upon the predetermined quantity of tobacco flavor substance prior to delivery to the smoker;

tobacco flavor medium disposed on the first surface of said carrier;

wherein when any one of said plurality of electrical heating elements is activated, a respective fraction of said tobacco flavor medium in thermal transfer relationship with said one of said heating means is heated, generating a predetermined quantity of tobacco flavor substance in said flavorant cavity for delivery to the smoker.

2. The article of claim 1 wherein said filter includes a free-flow filter located adjacent the second end of said carrier and said flavorant cavity, said free-flow filter providing structural support to the tobacco flavor unit.

3. The article of claim 1 wherein:

the carrier forms a substantially hollow cylinder with an inside surface and an outside surface, the plurality of permanent electrical heating elements disposed adjacent the outside surface of the carrier; and the tobacco flavor medium is disposed on the inside surface of the cylinder wherein the tobacco flavor substance is generated within the carrier;

said tobacco flavor unit further comprising a back-flow resistive element adjacent the first end of said carrier, said back-flow resistive element operative to reduce release of tobacco flavor substance from said first end.

4. The article of claim 3 wherein the back-flow resistive element comprises a substantially cylindrical filter having a surface which forms a part of the flavorant cavity of said carrier.

5. The article of claim 4, said tobacco flavor unit further comprising:

a substantially cylindrical aerosol barrier tube, concentric with and having a diameter larger than the carrier, wherein the inside surface of the barrier tube and the outside surface of the carrier define a region for placement of the plurality of permanent electrical heating elements, the barrier tube reducing the condensation of residual tobacco flavor substance on portions of the permanent cavity of the article.

6. The article of claim 5 wherein:

the substantially cylindrical aerosol barrier tube is attached to the free-flow filter by a collar of material having a large resistance to draw, wherein the collar is used to define the size of the heater placement region of the tobacco flavor unit.

7. The article of claim 2 wherein:

the carrier forms a substantially hollow cylinder with an inside surface and an outside surface, the plurality of permanent electrical heating elements disposed on the inside surface of the carrier; and the tobacco flavor medium is disposed on the outside surface of the carrier, wherein the tobacco flavor substance is generated outside the carrier;

said tobacco flavor unit further comprising a back-flow resistive element adjacent the first end of said carrier, said back-flow resistive element operative to reduce release of tobacco flavor substance from said first end.

8. The article of claim 7 wherein the free-flow filter and back-flow filter are substantially annular and each has a surface which forms a part of the flavorant cavity for generating the tobacco flavor substance.

9. The article of claim 8, said tobacco flavor unit further comprising:

a substantially cylindrical aerosol barrier tube, concentric with and having a diameter larger than the carrier, wherein the inside surface of the barrier tube and the outside surface of the carrier define the flavorant cavity, the barrier tube reducing the condensation of residual tobacco flavor substance on portions of the permanent cavity of the article.

10. The article of claim 9 further comprising:

a substantially cylindrical plug of material having a large resistance to draw and substantially filling the empty center portion of the free-flow filter.

11. The article of claim 2 further comprising:

a substantially cylindrical mouthpiece filter adjacent the free-flow filter; and overwrap paper for overwrapping the aerosol barrier tube and mouthpiece filter and for securing the mouthpiece filter to the aerosol barrier tube.

12. The article of claim 1 wherein:

the carrier is composed of a nonwoven carbon fiber mat.

13. The article of claim 12 wherein the carbon fibers in the mat have a basis weight in the range between about 6 $g/m^2$ and about 12 $g/m^2$.

14. The article of claim 1 wherein the tobacco flavor medium comprises a layer of tobacco material.

15. The article of claim 14 wherein the tobacco flavor medium comprises a continuous sheet of tobacco material.

16. The article of claim 14 wherein the tobacco flavor medium comprises a foam of tobacco material.

17. The article of claim 14 wherein the tobacco flavor medium comprises a gel of tobacco material.

18. The article of claim 14 wherein the tobacco flavor medium comprises a dried slurry of tobacco material.

19. The article of claim 18 wherein the tobacco flavor medium comprises a dried spray-deposited slurry of tobacco material.

20. The article of claim 14 wherein:

the tobacco flavor medium comprises a spatially-varying tobacco flavor medium; whereby:

the flavor delivery to a smoker varies selectively from puff to puff.

21. The article of claim 1 wherein the control means applies a first amount of said electrical energy to a first heater element and a second amount of said electrical energy to a second heater element so as to selectively vary the flavor delivery from puff to puff for a given tobacco flavor unit.

22. The article of claim 1 wherein the control means applies a first amount of said electrical energy, to each heater element for a first tobacco flavor unit, and a second amount of said electrical energy, to each heater element for a second tobacco flavor unit, so as to selectively vary the flavor delivery from tobacco flavor unit to tobacco flavor unit.

23. The article of claim 1 further including a means for indicating to the smoker that the tobacco flavor unit has been previously inserted into an article and subsequently removed.

24. The article of claim 23 wherein the indicating means must be removed from the tobacco flavor unit before the unit can be inserted into the smoking article.

25. The article of claim 23 wherein the indicating means is a region on the tobacco flavor unit which becomes physically altered upon insertion of the tobacco flavor unit into the smoking article.

26. The article of claim 1 further including a means for indicating to the smoker that the tobacco flavor unit has been previously heated.

27. The article of claim 26 wherein the indicating means is thermally activated and changes color to indicate that the tobacco flavor unit has been previously heated.

28. The article of claim 1 wherein the carrier is composed of a nonwoven carbon fiber mat having a preselected resistivity, and wherein the resistivity corresponds to a particular type of tobacco flavor unit so as to allow the control means of the smoking article to distinguish between different types of tobacco flavor units.

29. The article of claim 1 wherein the tobacco flavor unit further comprises a free-flow tubular element located at the second end of said carrier and adjacent said flavorant cavity, for providing structural support to the tobacco flavor unit.

30. A smoking article for delivering to a smoker a tobacco flavor substance, said article comprising:

a permanent heater fixture including:

a heater base defining a first end of a permanent cavity for receiving a removable tobacco flavor unit, and a plurality of permanent electrical heater elements disposed on the heater base, said heater elements each having a surface disposed along said permanent cavity;

a source of electrical energy for powering said plurality of heater elements;

control means for applying said electrical energy to said heater elements to selectively heat at least one of said plurality of heater elements; and a removable tobacco flavor unit received in the heater cavity in proximity to said plurality of heater elements, said tobacco flavor unit including a flavorant cavity and a tobacco flavor medium disposed along said flavorant cavity;

wherein when any one of said plurality of electrical heaters is activated, a respective fraction of said tobacco flavor medium in thermal transfer relationship with said one of said heating elements is heated, generating a predetermined quantity of tobacco flavor substance in said flavorant cavity for delivery to the smoker.

31. The article of claim 30 wherein the permanent cavity is substantially cylindrical; and wherein the fixture further comprises:

a plurality of heater support fingers disposed from the first end of the heater base for supporting the plurality of heater elements, wherein:

the fingers are elongate, have an inside surface and an outside surface, and are arranged to define a surface of a cylinder.

32. The article of claim 31 wherein the plurality of heater elements are mounted on the inside surface of the heater support fingers.

33. The article of claim 30 wherein the cavity of the heater base forms an annulus; and wherein the fixture further comprises:

a plurality of heater support fingers disposed from the first end of the heater base for supporting the plurality of heater elements, wherein the fingers are elongate and have an inside surface and an outside surface and are arranged so as to define a surface of a cylinder.

34. The article of claim 33 wherein the plurality of heater elements are mounted on the outside surface of the heater support fingers.

35. The article of claim 32 wherein the plurality of permanent heaters are comprised of silicon semiconductor material.

36. The article of claim 35 wherein the silicon semiconductor material is doped with phosphorous impurities to a level in the range of between about $5\times10^{18}$ impurities/$cm^3$ and about $5\times10^{19}$ impurities/$cm^3$.

37. The article of claim 34 wherein the plurality of permanent heaters are comprised of silicon semiconductor material.

38. The article of claim 37 wherein the silicon semiconductor material is doped with phosphorous impurities to a level in the range of between about $5\times10^{18}$ impurities/$cm^3$ and about $5\times10^{19}$ impurities/$cm^3$.

39. The article of claim 1 or 30 wherein said source of electrical energy comprises a battery.

40. The article of claim 39 wherein said source of electrical energy comprises a charge pump circuit coupled to said battery for boosting the voltage of said battery.

41. The article of claim 40 wherein said battery is disposable.

42. The article of claim 40 wherein said battery is rechargeable.

43. The article of claim 39 wherein said control means includes means for sequentially selecting members of said plurality of electrical heater elements; and a puff sensor operative when a smoker puffs upon said article so as to activate said selected heater element.

44. The article of claim 43 wherein said selecting means is manual.

45. The article of claim 44 wherein said selecting means is automatic.

46. The article of claim 44 wherein said automatic selecting means selects each of said plurality of electrical heating means.

47. The article of claim 45 wherein said control means further comprises sequential indication means for indicating the number of said plurality of electrical heater elements that can be sequentially heated until all of said plurality of electrical heating heater elements have been activated at least once for an associated removable tobacco flavor unit.

48. The article of claim 46 wherein said sequential indication means comprises a liquid crystal display.

49. The article of claim 48 wherein said liquid crystal display indicates when the battery voltage falls below a preselected LOW voltage level by repetitively cycling the display on and off.

50. The article of claim 48 wherein said liquid crystal display indicates when the battery voltage falls below a preselected LOW voltage level and when the battery has been recharged to preselected HIGH voltage level after falling below the preselected LOW voltage level.

51. The article of claim 48 wherein said liquid crystal display indicates when there is no tobacco flavor generating unit loaded into the article.

52. The article of claim 48 wherein said liquid crystal display indicates when there is no heater fixture loaded into the article.

53. The article of claim 45 wherein said pulse applying means applies a pulse of predetermined duration.

54. The article of claim 45 wherein said pulse applying means applies a pulse of predetermined duration in a range from about 0.5 second to about 5 seconds depending on the desired amount of energy that is meant to be delivered to said selected one of said electrical heater elements.

55. The article of claim 45 wherein said pulse applying means applies a pulse of predetermined duration in a range from about 1 second to about 3 seconds depending upon the amount of energy delivered to said selected one of said electrical heater elements.

56. The article of claim 45 wherein said pulse applying means applies a pulse of predetermined duration in a range from about 1 second to about 2seconds depending upon the amount of energy delivered to said selected one of said electrical heater elements.

57. The article of claim 45 wherein said pulse of electrical energy further comprises a pulse of a predetermined amount of electrical energy.

58. The article of claim 45 wherein said predetermined amount of electrical energy ranges from about 5 Joules to about 40 Joules.

59. The article of claim 45 wherein said predetermined amount of electrical energy ranges from about 15 Joules to about 25 Joules.

60. The article of claim 45 wherein said pulse applying means comprises actuation means and applies said pulse in response to actuation of said actuation means by a smoker.

61. The article of claim 45 wherein said actuation means comprises a pressure-sensitive sensor.

62. The article of claim 45 wherein said actuation means is cycled on and off so as to conserve the source of electrical energy.

63. The article of claim 62 wherein said actuation means is on for less than about 50 percent of a given time period.

64. The article of claim 63 wherein said actuation means is on for less than about 20 percent of a given time period.

65. The article of claim 64 wherein said actuation means is on for less than about 5 percent of a given time period.

66. The article of claim 30 wherein said control means comprises a field-programmable logic array.

67. The article of claim 39 wherein said control means further comprises a voltage detector circuit for detecting when the battery voltage falls below a preselected LOW voltage level and for detecting when the battery has been recharged to preselected HIGH voltage level after falling below the preselected LOW voltage level.

68. The article of claim 67 wherein said preselected LOW voltage level is less than about 5 volts and said preselected HIGH voltage level is greater than about 5 volts.

69. The article of claim 68 wherein said preselected LOW voltage level ranges from about 3 to about 3.5 volts and said preselected HIGH voltage level ranges from about 5 to about 6 about volts.

70. The article of claim 30 wherein the carrier is composed of a nonwoven carbon fiber mat having a preselected resistivity, and wherein the resistivity corresponds to a particular type of tobacco flavor unit so as to allow the smoking article to distinguish between different types of tobacco flavor units.

71. The article of claim 70 wherein said control means includes means for sequentially selecting members of said plurality of electrical heater elements; and a puff sensor operative when a smoker puffs upon said article so as to activate said selected heater element.

72. The article of claim 71 further comprising means to measure the preselected resistivity.

73. The article of claim 72 wherein a first pulse of electrical energy is applied to heat said selected one of said electrical heating elements if a first preselected resistivity is measured, and a second pulse of electrical energy is applied to heat said selected one of said electrical heating elements if a second preselected resistivity is measured.

74. The article of claim 1 wherein the tobacco flavor unit further comprises a free-flow tubular element located at the second end of said carrier and adjacent said flavorant cavity, for providing structural support to the tobacco flavor unit.

75. The smoking article of claim 30, wherein said plurality of heaters are located along said heater cavity in spaced-apart relation to said first end of said heater cavity such that when said tobacco flavor unit is fully received in said cavity said plurality of permanent heaters superpose at least a portion of said flavorant cavity.

* * * * *